US010598034B2

(12) United States Patent
Tsifourdaris

(10) Patent No.: US 10,598,034 B2
(45) Date of Patent: Mar. 24, 2020

(54) POWER TURBINE VANE AIRFOIL PROFILE

(71) Applicant: PRATT & WHITNEY CANADA CORP., Longueuil (CA)

(72) Inventor: Panagiota Tsifourdaris, Montreal (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 210 days.

(21) Appl. No.: 15/692,317

(22) Filed: Aug. 31, 2017

(65) Prior Publication Data

US 2019/0063242 A1 Feb. 28, 2019

(51) Int. Cl.
*F01D 9/04* (2006.01)
*F01D 5/14* (2006.01)

(52) U.S. Cl.
CPC ..... *F01D 9/041* (2013.01); *F01D 5/141* (2013.01); *F05D 2220/32* (2013.01); *F05D 2220/321* (2013.01); *F05D 2240/80* (2013.01); *F05D 2250/74* (2013.01)

(58) Field of Classification Search
CPC .... F01D 9/041; F01D 5/141; F05D 2220/321; F05D 2240/12; F05D 2250/74; F05D 2220/32; F05D 2240/80
USPC ..... 415/223
See application file for complete search history.

(56) References Cited

U.S. PATENT DOCUMENTS 6,398,489 B1 6/2002 Burdgick et al.
6,832,897 B2 12/2004 Urban
6,854,961 B2 2/2005 Zhang et al.
6,910,868 B2 6/2005 Hyde et al.
7,306,436 B2 12/2007 Girgis et al.
7,351,038 B2 4/2008 Girgis et al.
7,354,249 B2 4/2008 Girgis et al.
7,367,779 B2 5/2008 Girgis et al.
7,402,026 B2 7/2008 Girgis et al.
7,520,726 B2 4/2009 Papple et al.
7,520,727 B2 4/2009 Sreekanth et al.
7,520,728 B2 4/2009 Sleiman et al.
7,534,091 B2 5/2009 Ravanis et al.
7,537,432 B2 5/2009 Marini et al.
7,537,433 B2 5/2009 Girgis et al.
7,559,746 B2 7/2009 Tsifourdaris et al.
7,559,747 B2 7/2009 Mohan et al.
7,559,748 B2 7/2009 Kidikian et al.
7,559,749 B2 7/2009 Kidikian et al.
7,566,200 B2 7/2009 Marini et al.
7,568,889 B2 8/2009 Mohan et al.
7,568,890 B2 8/2009 Findlay et al.
7,568,891 B2 8/2009 Mohan et al.
7,611,326 B2 11/2009 Trindade et al.
7,625,182 B2 12/2009 Mah et al.
7,625,183 B2 12/2009 Tsifourdaris et al.
(Continued)

*Primary Examiner* — Joseph J Dallo
*Assistant Examiner* — Scott A Reinbold
(74) *Attorney, Agent, or Firm* — Norton Rose Fulbright Canada LLP

(57) ABSTRACT

A power turbine includes a second stage vane having an airfoil with a cold un-coated nominal profile substantially in accordance with at least an intermediate portion of the Cartesian coordinate values of X, Y and Z set forth in Table 2. The X and Y values are distances, which when smoothly connected by an appropriate continuing curve, define airfoil profile sections at each distance Z. The profile sections at each distance Z are joined smoothly to one another to form a complete airfoil shape.

10 Claims, 4 Drawing Sheets

(56) References Cited

U.S. PATENT DOCUMENTS

| | | | | |
|---|---|---|---|---|
| 7,632,074 | B2 | 12/2009 | Ravanis et al. | |
| 8,100,659 | B2 | 1/2012 | Marini | |
| 8,105,043 | B2 | 1/2012 | Tsifourdaris | |
| 8,105,044 | B2 | 1/2012 | Marini et al. | |
| 2005/0079061 | A1 | 4/2005 | Beddard | |
| 2008/0124219 | A1 | 5/2008 | Kidikian et al. | |
| 2009/0097982 | A1 | 4/2009 | Saindon et al. | |
| 2009/0116967 | A1 | 5/2009 | Sleiman et al. | |
| 2010/0008784 | A1 | 1/2010 | Shafique et al. | |
| 2011/0229317 | A1 | 9/2011 | Marini | |
| 2011/0236214 | A1 | 9/2011 | Tsifourdaris | |
| 2011/0243747 | A1 | 10/2011 | Marini | |
| 2011/0243748 | A1 | 10/2011 | Tsifourdaris | |
| 2019/0063225 | A1* | 2/2019 | Mohan | F01D 5/141 |
| 2019/0071974 | A1* | 3/2019 | Mohan | F01D 5/141 |
| 2019/0093482 | A1* | 3/2019 | Moradi | F01D 9/041 |

* cited by examiner

POWER TURBINE VANE AIRFOIL PROFILE

TECHNICAL FIELD

The application relates generally to a vane airfoil and, more particularly, to an airfoil profile suited for use in a power turbine stage of a gas turbine engine.

BACKGROUND OF THE ART

Every stage of a gas turbine engine must meet a plurality of design criteria to assure the best possible overall engine efficiency. The design goals dictate specific thermal and mechanical requirements that must be met pertaining to heat loading, parts life and manufacturing, use of combustion gases, throat area, vectoring, the interaction between stages to name a few. The design criteria for each stage is constantly being re-evaluated and improved upon. Each airfoil is subject to flow regimes which lend themselves easily to flow separation, which tend to limit the amount of work transferred to the compressor, and hence the total thrust or power capability of the engine. The vanes of a power turbine are also subject to harsh temperatures and pressures, which require a solid balance between aerodynamic and structural optimization. Therefore, improvements in airfoil design are sought.

SUMMARY

In one aspect, the present application provides a turbine vane for a gas turbine engine having a gaspath, the vane comprising an airfoil having an intermediate portion contained within the gaspath and defined by a nominal profile substantially in accordance with Cartesian coordinate values of X, Y, and Z of Sections 2 to 10 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, the present application provides a turbine vane for a gas turbine engine having a gaspath, the turbine vane having a cold uncoated intermediate airfoil portion contained within the gaspath and defined by a nominal profile substantially in accordance with Cartesian coordinate values of X, Y, and Z of Sections 2 to 10 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, the present application provides a turbine stator assembly for a gas turbine engine having a gaspath, the assembly comprising a plurality of vanes, each vane including an airfoil having an intermediate portion contained with the gaspath of the engine and defined by an un-coated nominal profile substantially in accordance with Cartesian coordinate values of X, Y, and Z of Sections 2 to 10 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In a still further aspect of the present application, there is provided a second stage power turbine vane comprising: at least one airfoil having a surface lying substantially on the points of Table 2, the airfoil extending between platforms defined generally by at least some of the coordinate values given in Table 1, wherein a fillet radius is applied around the airfoil between the airfoil and platforms.

Further details of these and other aspects of the present application will be apparent from the detailed description and figures included below.

DESCRIPTION OF THE DRAWINGS

Reference is now made to the accompanying figures depicting aspects of the present invention, in which.

DETAILED DESCRIPTION

Figure 1:
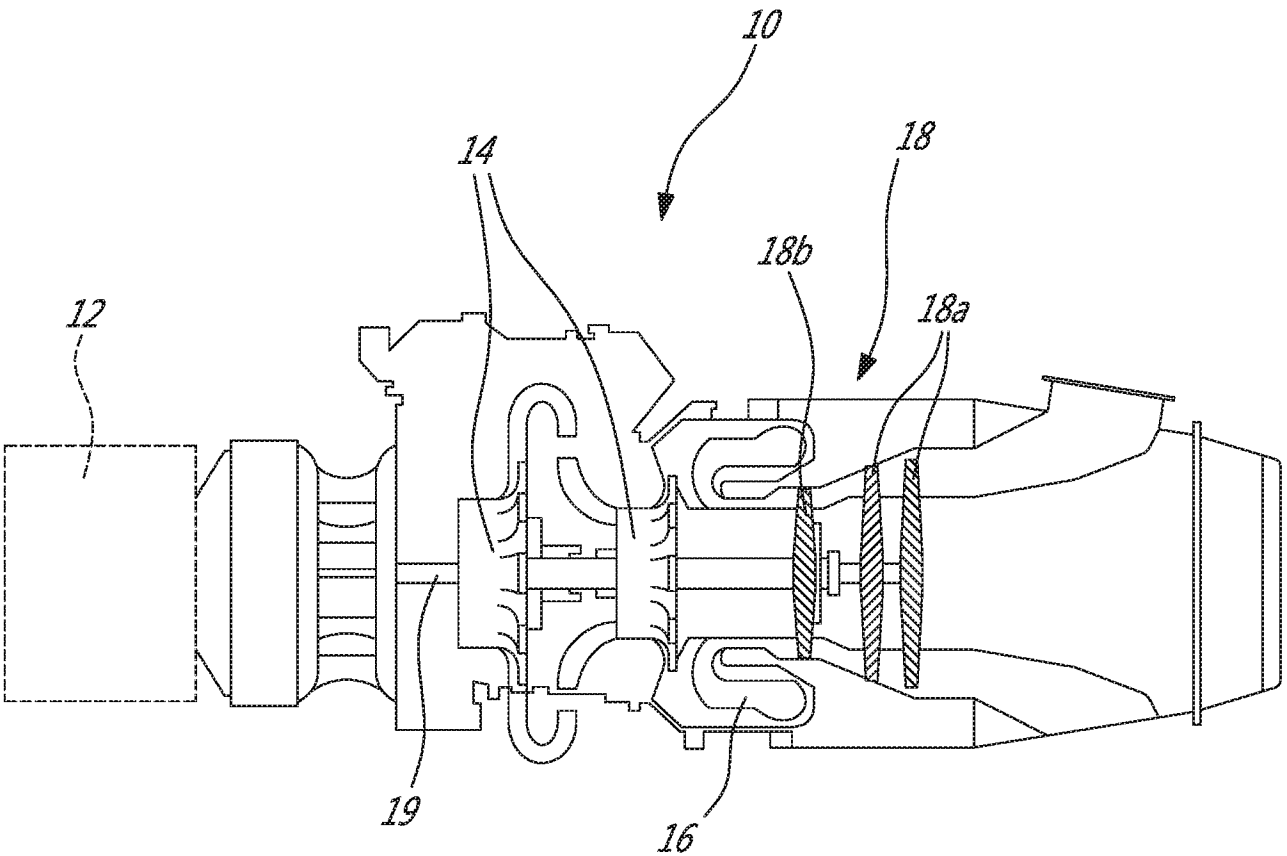
FIG. 1 is a schematic view of a turboshaft gas turbine engine.

FIG. 1 illustrates a turboshaft gas turbine engine 10 of a type preferably provided for use in subsonic flight, generally comprising in serial flow communication a multi-stage compressor section 14 for pressurizing the air, a combustor 16 in which the compressed air is mixed with fuel and ignited for generating an annular stream of hot combustion gases, and a turbine section 18 for extracting energy from the combustion gases. According to the illustrated example, the turbine section 18 comprises a two-stage power turbine 18*a* and a single-stage compressor turbine 18*b*. The power turbine 18*a* drives a rotatable load 12 (e.g. a helicopter rotor) via a low pressure shaft 19. Each power turbine stage comprises a set of circumferentially spaced-apart blades radiating from a disk mounted for rotation about a central axis of the engine 10.

Figure 2:
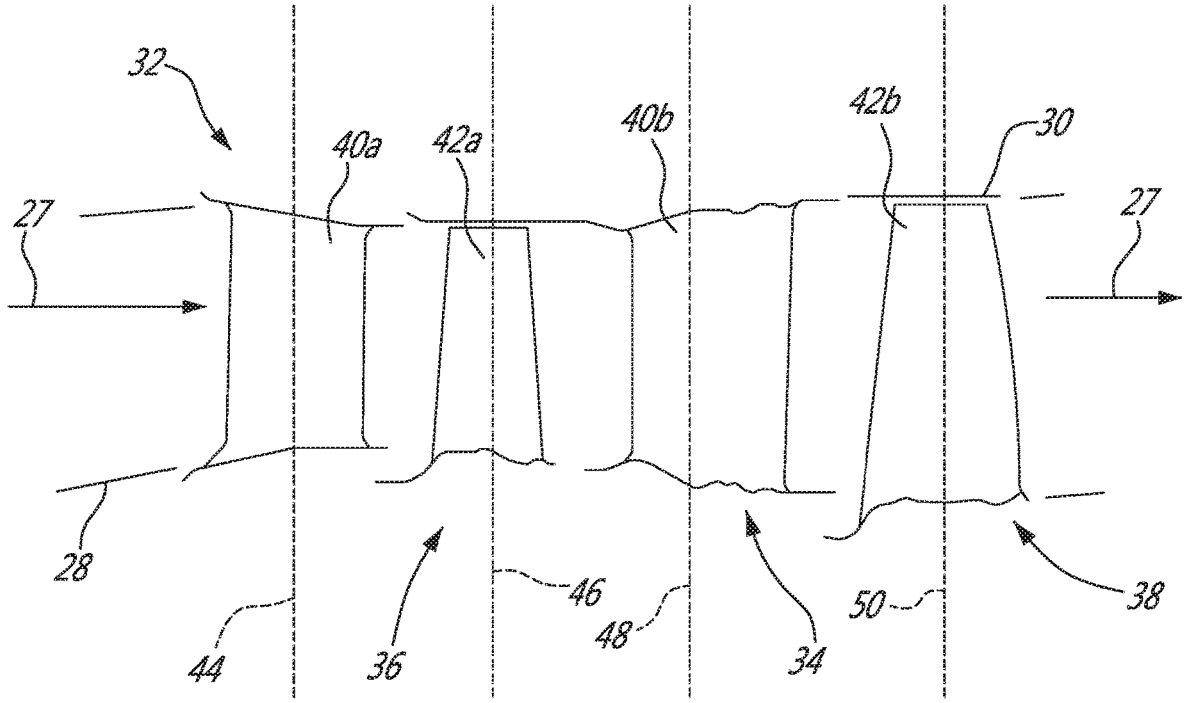
FIG. 2 is a schematic view of a power turbine section of a gaspath of the engine shown in FIG. 1, including a two-stage power turbine.
Figure 2:
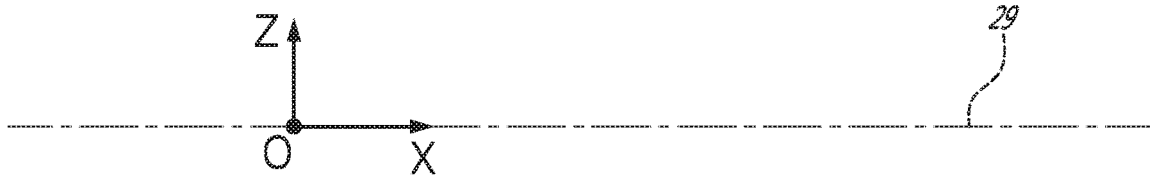

FIG. 2 illustrates a portion of an annular hot gaspath of the power turbine 18*a*. Arrow 27 illustrate the flow of hot combustion gases through the power turbine 18*a*. The gaspath is defined by annular inner and outer walls 28 and 30 respectively, for directing the stream of hot combustion gases axially in an annular flow through the power turbine 18*a*. The profile of the inner and outer walls 28 and 30 of the cold coated annular gaspath is defined by Cartesian coordinate values such as the ones given in Table 1 below. More particularly, the inner and outer gaspath walls 28 and 30 are defined with respect to mutually orthogonal x and z axes, as shown in FIG. 2. The x axis corresponds to the engine turbine rotor centerline 29. The radial distance of the inner and outer walls 28 and 30 from the engine turbine rotor centerline and, thus, from the x-axis at specific axial locations is measured along the z axis. The z values provide the inner and outer radius of the gas path at various axial locations therealong. The x and z coordinate values in Table 1 are distances given in inches from the point of origin O (see FIG. 2). It is understood that other units of dimensions may be used. The x and z values have in average a manufacturing tolerance of about ±0.030". The tolerance may account for such things as casting, coating, ceramic coating and/or other tolerances. It is understood that the manufacturing tolerances of the gas path may vary along the length thereof.

The power turbine section 18*a* has two stages located in the gaspath downstream of the combustor 16 and the compressor turbine 18*b*. Referring to FIG. 2, the power turbine stages each comprise a stator assembly 32, 34 and a rotor assembly 36, 38 having a plurality of circumferentially arranged vane 40*a*, 40*b* and blades 42*a*, 42*b* respectively. The vanes 40*a*,40*b* and blades 42*a*,42*b* are mounted in position along respective stacking lines 44-50, as identified in FIG. 2. The stacking lines 44-50 extend in the radial direction along the z axis at different axial locations. The stacking lines 44-50 define the axial location where the blades and vanes of each stage are mounted in the engine 10. More specifically, stacking line 48 located at x=0 corresponds to the second stage of vanes 40*b* of the power turbine 18*a*.

TABLE 1

| Cold Un-Coated Gaspath definition | |
|---|---|
| X | Z |
| ID Gaspath | |
| −0.40500 | 3.41000 |
| −0.38344 | 3.41000 |
| −0.36189 | 3.41000 |
| −0.34033 | 3.41000 |
| −0.31878 | 3.41000 |
| −0.29722 | 3.41000 |
| −0.27567 | 3.41000 |
| −0.25411 | 3.41000 |
| −0.23256 | 3.41000 |
| −0.21100 | 3.41000 |
| −0.18945 | 3.41000 |
| −0.16789 | 3.41000 |
| −0.14634 | 3.41000 |
| −0.12478 | 3.41000 |
| −0.10323 | 3.41000 |
| −0.08167 | 3.41000 |
| −0.06012 | 3.41000 |
| −0.03856 | 3.41000 |
| −0.01700 | 3.41000 |
| 0.00000 | 3.41000 |
| 0.00455 | 3.41000 |
| 0.02611 | 3.40993 |
| 0.04766 | 3.40975 |
| 0.06921 | 3.40947 |
| 0.09077 | 3.40909 |
| 0.11232 | 3.40860 |
| 0.13386 | 3.40801 |
| 0.15541 | 3.40732 |
| 0.17695 | 3.40653 |
| 0.19848 | 3.40563 |
| 0.22002 | 3.40463 |
| 0.24154 | 3.40352 |
| 0.26306 | 3.40231 |
| 0.28458 | 3.40100 |
| 0.30609 | 3.39959 |
| 0.32759 | 3.39807 |
| 0.34908 | 3.39645 |
| 0.37057 | 3.39473 |
| 0.39205 | 3.39291 |
| 0.41298 | 3.38825 |
| 0.43060 | 3.37607 |
| 0.44400 | 3.35921 |
| 0.45712 | 3.34211 |
| 0.47143 | 3.32608 |
| 0.49043 | 3.31620 |
| 0.51178 | 3.31400 |
| 0.53333 | 3.31400 |
| 0.55489 | 3.31400 |

TABLE 1-continued

| Cold Un-Coated Gaspath definition | |
|---|---|
| X | Z |
| 0.57644 | 3.31400 |
| 0.59800 | 3.31400 |
| OD Gaspath | |
| −0.76500 | 5.78004 |
| −0.73344 | 5.77009 |
| −0.70189 | 5.76014 |
| −0.67033 | 5.75019 |
| −0.63877 | 5.74024 |
| −0.60722 | 5.73029 |
| −0.57566 | 5.72034 |
| −0.54411 | 5.71039 |
| −0.51255 | 5.70044 |
| −0.48099 | 5.69049 |
| −0.44944 | 5.68054 |
| −0.41788 | 5.67059 |
| −0.38632 | 5.66064 |
| −0.35477 | 5.65069 |
| −0.32321 | 5.64074 |
| −0.29166 | 5.63079 |
| −0.26010 | 5.62084 |
| −0.22854 | 5.61090 |
| −0.19699 | 5.60095 |
| −0.16543 | 5.59100 |
| −0.13387 | 5.58105 |
| −0.10232 | 5.57110 |
| −0.07076 | 5.56115 |
| −0.03921 | 5.55120 |
| −0.00765 | 5.54125 |
| 0.00000 | 5.53884 |
| 0.02392 | 5.53136 |
| 0.05558 | 5.52173 |
| 0.08732 | 5.51238 |
| 0.11914 | 5.50332 |
| 0.15105 | 5.49455 |
| 0.18303 | 5.48606 |
| 0.21508 | 5.47785 |
| 0.24721 | 5.46993 |
| 0.27940 | 5.46231 |
| 0.31164 | 5.45486 |
| 0.34388 | 5.44742 |
| 0.37612 | 5.43997 |
| 0.40836 | 5.43253 |
| 0.44060 | 5.42509 |
| 0.47284 | 5.41764 |
| 0.50508 | 5.41020 |
| 0.53747 | 5.40346 |
| 0.57014 | 5.39826 |
| 0.60303 | 5.39461 |
| 0.63605 | 5.39252 |
| 0.66913 | 5.39199 |
| 0.70219 | 5.39302 |
| 0.73518 | 5.39561 |
| 0.76800 | 5.39976 |

Figure 3:
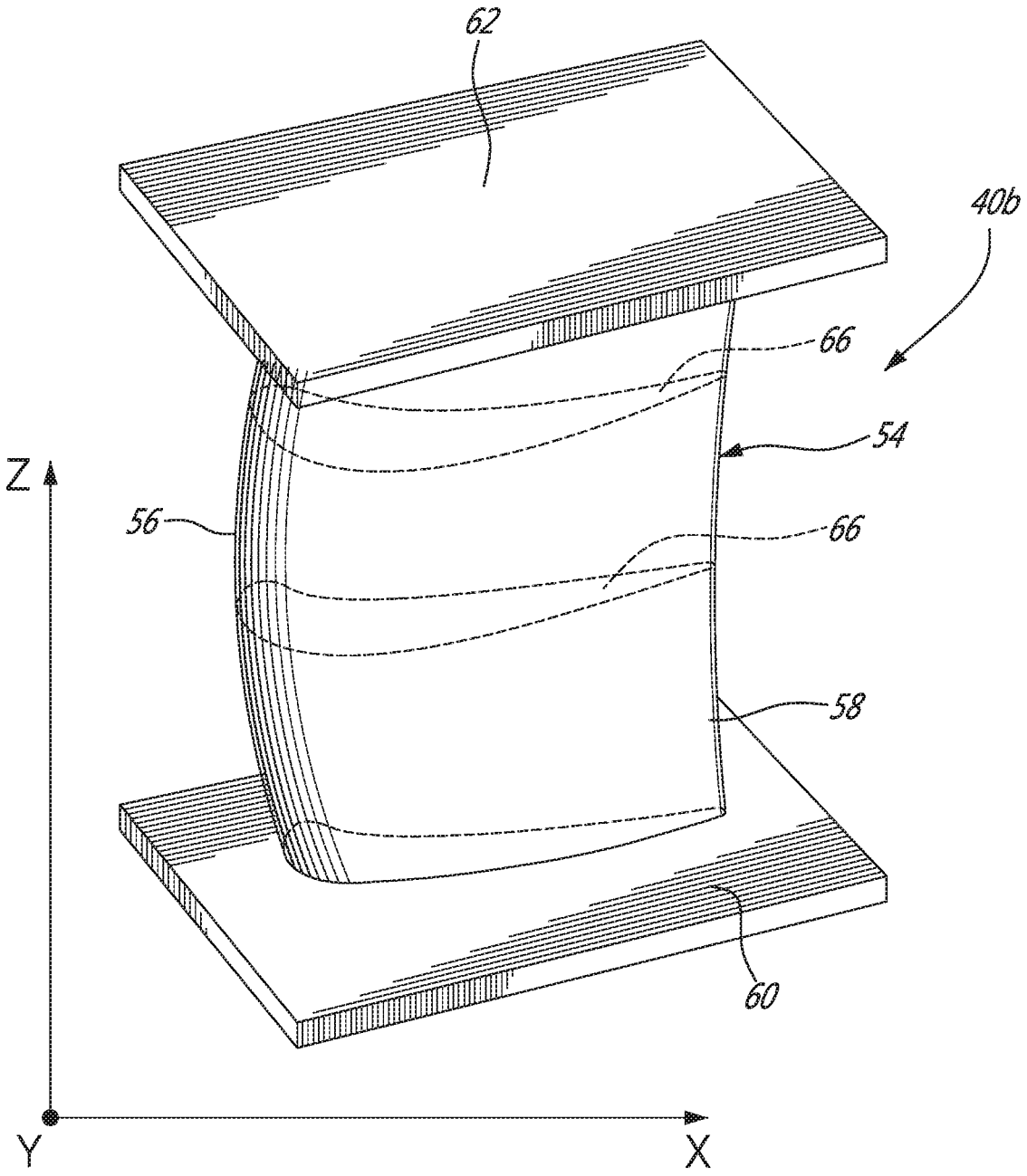
FIG. 3 is a schematic perspective view of a second stage power turbine vane having a vane profile defined in accordance with an embodiment of the present application.

More specifically, the stator assemblies 32, 34 each include a plurality of circumferentially distributed vanes 40*a* and 40*b* respectively which extend radially across the hot gaspath 27. FIG. 3 shows an example of a vane 40*b* of the second stage of the power turbine 18*a*. It can be seen that each vane 40*b* has an airfoil 54 having a leading edge 56 and a trailing edge 58, extending between an inner platform 60 and an outer platform 62.

The novel airfoil shape of each second stage power turbine vane 40*b* is defined by a set of X-Y-Z points in space. This set of points represents a novel and unique solution to the target design criteria discussed above, and are well-adapted for use in a two-stage power turbine design. The set of points are defined in a Cartesian coordinate system which has mutually orthogonal X, Y and Z axes. The X axis extends axially along the turbine rotor centerline 29, i.e., the rotary axis. The positive X direction is axially towards the aft of the turbine engine 10. The Z axis extends along the vane stacking line 48 of each respective vane 40*b* in a generally radial direction and intersects the X axis. The positive Z direction is radially outwardly toward the outer shroud 62 of the vane. The Y axis extends tangentially with the positive Y direction being in the direction of rotation of the rotor assembly 36. Therefore, the origin of the X, Y and Z axes is defined at the point of intersection of all three orthogonally-related axes: that is the point (0,0,0) at the intersection of the center of rotation of the turbine engine 10 and the stacking line 48.

In a particular embodiment of the second stage power turbine vane, the set of points which define the vane airfoil profile relative to the axis of rotation of the turbine engine 10 and stacking line 48 thereof are set out in Table 2 below as X, Y and Z Cartesian coordinate values. Particularly, the vane airfoil profile is defined by profile sections 66 at various locations along its height, the locations represented by Z values. For example, if the vanes 40*b* are mounted at an angle with respect to the radial direction, then the Z values are not a true representation of the height of the airfoils of the vanes 40*b*. Furthermore, it is to be appreciated that, with respect to Table 2, Z values are not actually radial heights, per se, from the centerline but rather a height from a plane through the centerline—i.e. the sections in Table 2 are planar. The coordinate values are set forth in inches in Table 2 although other units of dimensions may be used when the values are appropriately converted.

Thus, at each Z distance, the X and Y coordinate values of the desired profile section 66 are defined at selected locations in a Z direction normal to the X, Y plane. The X and Y coordinates are given in distance dimensions, e.g., units of inches, and are joined smoothly, using appropriate curve-fitting techniques, at each Z location to form a smooth continuous airfoil cross-section. The vane airfoil profiles of the various surface locations between the distances Z are determined by smoothly connecting the adjacent profile sections 66 to one another to form the airfoil profile.

The coordinate values listed in Table 2 below represent the desired airfoil profiles in a "cold" non-operating uncoated condition (and at nominal restagger). However, the manufactured airfoil surface profile will be slightly different, as a result of manufacturing and applied coating tolerances. According to an embodiment of the present invention, the finished vane is coated with a thermal protecting layer.

The Table 2 values are generated and shown to three decimal places for determining the profile of the second stage power turbine vane airfoil. However, as mentioned above, there are manufacturing tolerance issues to be addressed and, accordingly, the values for the profile given in Table 2 are for a theoretical airfoil. A profile tolerance of ±0.018 inches, measured perpendicularly to the airfoil surface is additive to the nominal values given in Table 2 below. The vane airfoil design functions well within these ranges of variation. The cold or room temperature profile is given by the X, Y and Z coordinates for manufacturing purposes. It is understood that the airfoil may deform, within acceptable limits, once entering service.

The coordinate values given in Table 2 below provide the preferred nominal second stage power turbine vane airfoil profile.

TABLE 2

| | X | Y | Z |
|---|---|---|---|
| SECTION 1 | | | |
| | −0.256 | 0.202 | 3.295 |
| | −0.255 | 0.200 | 3.295 |
| | −0.253 | 0.199 | 3.295 |
| | −0.252 | 0.198 | 3.295 |
| | −0.251 | 0.196 | 3.295 |
| | −0.250 | 0.195 | 3.295 |
| | −0.248 | 0.194 | 3.295 |
| | −0.247 | 0.192 | 3.295 |
| | −0.246 | 0.191 | 3.295 |
| | −0.245 | 0.190 | 3.295 |
| | −0.244 | 0.188 | 3.295 |
| | −0.237 | 0.182 | 3.295 |
| | −0.231 | 0.175 | 3.295 |
| | −0.225 | 0.169 | 3.295 |
| | −0.218 | 0.162 | 3.295 |
| | −0.212 | 0.156 | 3.295 |
| | −0.205 | 0.149 | 3.295 |
| | −0.199 | 0.143 | 3.295 |
| | −0.192 | 0.137 | 3.295 |
| | −0.186 | 0.131 | 3.295 |
| | −0.179 | 0.125 | 3.295 |
| | −0.172 | 0.118 | 3.295 |
| | −0.166 | 0.112 | 3.295 |
| | −0.159 | 0.106 | 3.295 |
| | −0.152 | 0.100 | 3.295 |
| | −0.145 | 0.095 | 3.295 |
| | −0.138 | 0.089 | 3.295 |
| | −0.131 | 0.083 | 3.295 |
| | −0.124 | 0.077 | 3.295 |
| | −0.117 | 0.071 | 3.295 |
| | −0.110 | 0.066 | 3.295 |
| | −0.103 | 0.060 | 3.295 |
| | −0.096 | 0.055 | 3.295 |
| | −0.089 | 0.049 | 3.295 |
| | −0.081 | 0.043 | 3.295 |
| | −0.074 | 0.038 | 3.295 |
| | −0.067 | 0.033 | 3.295 |
| | −0.060 | 0.027 | 3.295 |
| | −0.052 | 0.022 | 3.295 |
| | −0.045 | 0.017 | 3.295 |
| | −0.038 | 0.011 | 3.295 |
| | −0.030 | 0.006 | 3.295 |
| | −0.023 | 0.001 | 3.295 |
| | −0.015 | −0.004 | 3.295 |
| | −0.008 | −0.009 | 3.295 |
| | 0.000 | −0.014 | 3.295 |
| | 0.007 | −0.019 | 3.295 |
| | 0.015 | −0.024 | 3.295 |
| | 0.023 | −0.029 | 3.295 |
| | 0.031 | −0.034 | 3.295 |
| | 0.038 | −0.038 | 3.295 |
| | 0.046 | −0.043 | 3.295 |
| | 0.054 | −0.047 | 3.295 |
| | 0.062 | −0.052 | 3.295 |
| | 0.070 | −0.056 | 3.295 |
| | 0.078 | −0.060 | 3.295 |
| | 0.086 | −0.064 | 3.295 |
| | 0.095 | −0.068 | 3.295 |
| | 0.103 | −0.071 | 3.295 |
| | 0.111 | −0.075 | 3.295 |
| | 0.120 | −0.078 | 3.295 |
| | 0.128 | −0.082 | 3.295 |
| | 0.137 | −0.085 | 3.295 |
| | 0.145 | −0.088 | 3.295 |
| | 0.154 | −0.090 | 3.295 |
| | 0.163 | −0.093 | 3.295 |
| | 0.171 | −0.095 | 3.295 |
| | 0.180 | −0.097 | 3.295 |
| | 0.189 | −0.098 | 3.295 |
| | 0.198 | −0.100 | 3.295 |
| | 0.207 | −0.101 | 3.295 |
| | 0.216 | −0.101 | 3.295 |
| | 0.225 | −0.102 | 3.295 |
| | 0.234 | −0.102 | 3.295 |
| | 0.243 | −0.102 | 3.295 |
| | 0.252 | −0.101 | 3.295 |

TABLE 2-continued

| X | Y | Z |
|---|---|---|
| 0.261 | −0.100 | 3.295 |
| 0.270 | −0.099 | 3.295 |
| 0.279 | −0.097 | 3.295 |
| 0.288 | −0.095 | 3.295 |
| 0.297 | −0.093 | 3.295 |
| 0.306 | −0.090 | 3.295 |
| 0.314 | −0.087 | 3.295 |
| 0.323 | −0.084 | 3.295 |
| 0.331 | −0.080 | 3.295 |
| 0.339 | −0.076 | 3.295 |
| 0.347 | −0.072 | 3.295 |
| 0.355 | −0.067 | 3.295 |
| 0.362 | −0.062 | 3.295 |
| 0.369 | −0.056 | 3.295 |
| 0.371 | −0.055 | 3.295 |
| 0.372 | −0.054 | 3.295 |
| 0.374 | −0.053 | 3.295 |
| 0.375 | −0.052 | 3.295 |
| 0.376 | −0.051 | 3.295 |
| 0.378 | −0.050 | 3.295 |
| 0.379 | −0.048 | 3.295 |
| 0.381 | −0.047 | 3.295 |
| 0.382 | −0.046 | 3.295 |
| 0.383 | −0.045 | 3.295 |
| −0.240 | 0.221 | 3.295 |
| −0.242 | 0.222 | 3.295 |
| −0.244 | 0.222 | 3.295 |
| −0.245 | 0.223 | 3.295 |
| −0.247 | 0.223 | 3.295 |
| −0.249 | 0.222 | 3.295 |
| −0.251 | 0.222 | 3.295 |
| −0.253 | 0.221 | 3.295 |
| −0.255 | 0.220 | 3.295 |
| −0.256 | 0.218 | 3.295 |
| −0.257 | 0.217 | 3.295 |
| −0.258 | 0.215 | 3.295 |
| −0.259 | 0.213 | 3.295 |
| −0.259 | 0.211 | 3.295 |
| −0.259 | 0.209 | 3.295 |
| −0.259 | 0.207 | 3.295 |
| −0.258 | 0.205 | 3.295 |
| −0.257 | 0.203 | 3.295 |
| 0.364 | −0.007 | 3.295 |
| 0.362 | −0.007 | 3.295 |
| 0.360 | −0.008 | 3.295 |
| 0.359 | −0.008 | 3.295 |
| 0.357 | −0.009 | 3.295 |
| 0.356 | −0.009 | 3.295 |
| 0.354 | −0.009 | 3.295 |
| 0.353 | −0.010 | 3.295 |
| 0.351 | −0.010 | 3.295 |
| 0.350 | −0.011 | 3.295 |
| 0.348 | −0.011 | 3.295 |
| 0.340 | −0.013 | 3.295 |
| 0.332 | −0.015 | 3.295 |
| 0.324 | −0.016 | 3.295 |
| 0.316 | −0.018 | 3.295 |
| 0.308 | −0.019 | 3.295 |
| 0.300 | −0.021 | 3.295 |
| 0.292 | −0.022 | 3.295 |
| 0.284 | −0.023 | 3.295 |
| 0.276 | −0.023 | 3.295 |
| 0.268 | −0.024 | 3.295 |
| 0.260 | −0.024 | 3.295 |
| 0.252 | −0.025 | 3.295 |
| 0.244 | −0.025 | 3.295 |
| 0.235 | −0.025 | 3.295 |
| 0.227 | −0.025 | 3.295 |
| 0.219 | −0.024 | 3.295 |
| 0.211 | −0.024 | 3.295 |
| 0.203 | −0.023 | 3.295 |
| 0.195 | −0.022 | 3.295 |
| 0.187 | −0.021 | 3.295 |
| 0.179 | −0.020 | 3.295 |
| 0.171 | −0.018 | 3.295 |
| 0.163 | −0.017 | 3.295 |
| 0.155 | −0.015 | 3.295 |
| 0.147 | −0.013 | 3.295 |

TABLE 2-continued

| X | Y | Z |
|---|---|---|
| 0.139 | −0.011 | 3.295 |
| 0.131 | −0.009 | 3.295 |
| 0.124 | −0.007 | 3.295 |
| 0.116 | −0.005 | 3.295 |
| 0.108 | −0.002 | 3.295 |
| 0.100 | 0.000 | 3.295 |
| 0.093 | 0.003 | 3.295 |
| 0.085 | 0.006 | 3.295 |
| 0.077 | 0.009 | 3.295 |
| 0.070 | 0.012 | 3.295 |
| 0.062 | 0.015 | 3.295 |
| 0.055 | 0.018 | 3.295 |
| 0.048 | 0.021 | 3.295 |
| 0.040 | 0.025 | 3.295 |
| 0.033 | 0.028 | 3.295 |
| 0.026 | 0.032 | 3.295 |
| 0.018 | 0.035 | 3.295 |
| 0.011 | 0.039 | 3.295 |
| 0.004 | 0.043 | 3.295 |
| −0.003 | 0.047 | 3.295 |
| −0.010 | 0.051 | 3.295 |
| −0.017 | 0.055 | 3.295 |
| −0.024 | 0.059 | 3.295 |
| −0.031 | 0.063 | 3.295 |
| −0.038 | 0.067 | 3.295 |
| −0.045 | 0.072 | 3.295 |
| −0.052 | 0.076 | 3.295 |
| −0.059 | 0.080 | 3.295 |
| −0.066 | 0.085 | 3.295 |
| −0.072 | 0.089 | 3.295 |
| −0.079 | 0.094 | 3.295 |
| −0.086 | 0.098 | 3.295 |
| −0.092 | 0.103 | 3.295 |
| −0.099 | 0.108 | 3.295 |
| −0.106 | 0.112 | 3.295 |
| −0.112 | 0.117 | 3.295 |
| −0.119 | 0.122 | 3.295 |
| −0.125 | 0.127 | 3.295 |
| −0.132 | 0.132 | 3.295 |
| −0.138 | 0.137 | 3.295 |
| −0.145 | 0.142 | 3.295 |
| −0.151 | 0.147 | 3.295 |
| −0.157 | 0.152 | 3.295 |
| −0.164 | 0.157 | 3.295 |
| −0.170 | 0.162 | 3.295 |
| −0.176 | 0.167 | 3.295 |
| −0.183 | 0.172 | 3.295 |
| −0.189 | 0.177 | 3.295 |
| −0.195 | 0.182 | 3.295 |
| −0.201 | 0.188 | 3.295 |
| −0.208 | 0.193 | 3.295 |
| −0.214 | 0.198 | 3.295 |
| −0.220 | 0.203 | 3.295 |
| −0.226 | 0.209 | 3.295 |
| −0.227 | 0.210 | 3.295 |
| −0.229 | 0.211 | 3.295 |
| −0.230 | 0.212 | 3.295 |
| −0.231 | 0.213 | 3.295 |
| −0.232 | 0.214 | 3.295 |
| −0.233 | 0.215 | 3.295 |
| −0.235 | 0.216 | 3.295 |
| −0.236 | 0.217 | 3.295 |
| −0.237 | 0.218 | 3.295 |
| −0.238 | 0.219 | 3.295 |
| 0.386 | −0.042 | 3.295 |
| 0.388 | −0.040 | 3.295 |
| 0.390 | −0.037 | 3.295 |
| 0.392 | −0.034 | 3.295 |
| 0.394 | −0.031 | 3.295 |
| 0.395 | −0.027 | 3.295 |
| 0.395 | −0.024 | 3.295 |
| 0.395 | −0.020 | 3.295 |
| 0.394 | −0.017 | 3.295 |
| 0.393 | −0.014 | 3.295 |
| 0.391 | −0.011 | 3.295 |
| 0.388 | −0.009 | 3.295 |
| 0.385 | −0.007 | 3.295 |
| 0.381 | −0.006 | 3.295 |

TABLE 2-continued

| | X | Y | Z |
|---|---|---|---|
| | 0.378 | −0.006 | 3.295 |
| | 0.374 | −0.005 | 3.295 |
| | 0.371 | −0.006 | 3.295 |
| | 0.367 | −0.006 | 3.295 |
| SECTION 2 | | | |
| | 0.387 | −0.070 | 3.565 |
| | 0.385 | −0.071 | 3.565 |
| | 0.384 | −0.072 | 3.565 |
| | 0.382 | −0.074 | 3.565 |
| | 0.381 | −0.075 | 3.565 |
| | 0.379 | −0.076 | 3.565 |
| | 0.377 | −0.077 | 3.565 |
| | 0.376 | −0.078 | 3.565 |
| | 0.374 | −0.079 | 3.565 |
| | 0.372 | −0.080 | 3.565 |
| | 0.371 | −0.081 | 3.565 |
| | 0.362 | −0.085 | 3.565 |
| | 0.354 | −0.090 | 3.565 |
| | 0.345 | −0.094 | 3.565 |
| | 0.336 | −0.097 | 3.565 |
| | 0.327 | −0.101 | 3.565 |
| | 0.318 | −0.104 | 3.565 |
| | 0.309 | −0.107 | 3.565 |
| | 0.300 | −0.109 | 3.565 |
| | 0.290 | −0.111 | 3.565 |
| | 0.281 | −0.113 | 3.565 |
| | 0.271 | −0.114 | 3.565 |
| | 0.262 | −0.115 | 3.565 |
| | 0.252 | −0.116 | 3.565 |
| | 0.242 | −0.116 | 3.565 |
| | 0.233 | −0.116 | 3.565 |
| | 0.223 | −0.116 | 3.565 |
| | 0.214 | −0.115 | 3.565 |
| | 0.204 | −0.114 | 3.565 |
| | 0.194 | −0.113 | 3.565 |
| | 0.185 | −0.112 | 3.565 |
| | 0.176 | −0.110 | 3.565 |
| | 0.166 | −0.108 | 3.565 |
| | 0.157 | −0.105 | 3.565 |
| | 0.148 | −0.103 | 3.565 |
| | 0.138 | −0.100 | 3.565 |
| | 0.129 | −0.097 | 3.565 |
| | 0.120 | −0.093 | 3.565 |
| | 0.111 | −0.090 | 3.565 |
| | 0.102 | −0.086 | 3.565 |
| | 0.094 | −0.082 | 3.565 |
| | 0.085 | −0.078 | 3.565 |
| | 0.076 | −0.074 | 3.565 |
| | 0.068 | −0.070 | 3.565 |
| | 0.059 | −0.065 | 3.565 |
| | 0.051 | −0.060 | 3.565 |
| | 0.042 | −0.055 | 3.565 |
| | 0.034 | −0.051 | 3.565 |
| | 0.026 | −0.045 | 3.565 |
| | 0.018 | −0.040 | 3.565 |
| | 0.010 | −0.035 | 3.565 |
| | 0.002 | −0.030 | 3.565 |
| | −0.006 | −0.024 | 3.565 |
| | −0.014 | −0.019 | 3.565 |
| | −0.022 | −0.013 | 3.565 |
| | −0.029 | −0.007 | 3.565 |
| | −0.037 | −0.001 | 3.565 |
| | −0.045 | 0.004 | 3.565 |
| | −0.052 | 0.010 | 3.565 |
| | −0.060 | 0.016 | 3.565 |
| | −0.067 | 0.022 | 3.565 |
| | −0.075 | 0.029 | 3.565 |
| | −0.082 | 0.035 | 3.565 |
| | −0.089 | 0.041 | 3.565 |
| | −0.097 | 0.047 | 3.565 |
| | −0.104 | 0.053 | 3.565 |
| | −0.111 | 0.060 | 3.565 |
| | −0.119 | 0.066 | 3.565 |
| | −0.126 | 0.073 | 3.565 |
| | −0.133 | 0.079 | 3.565 |
| | −0.140 | 0.086 | 3.565 |
| | −0.147 | 0.092 | 3.565 |

TABLE 2-continued

| X | Y | Z |
|---|---|---|
| −0.154 | 0.099 | 3.565 |
| −0.161 | 0.105 | 3.565 |
| −0.168 | 0.112 | 3.565 |
| −0.175 | 0.119 | 3.565 |
| −0.181 | 0.126 | 3.565 |
| −0.188 | 0.133 | 3.565 |
| −0.195 | 0.139 | 3.565 |
| −0.201 | 0.146 | 3.565 |
| −0.208 | 0.153 | 3.565 |
| −0.215 | 0.160 | 3.565 |
| −0.221 | 0.167 | 3.565 |
| −0.228 | 0.175 | 3.565 |
| −0.234 | 0.182 | 3.565 |
| −0.241 | 0.189 | 3.565 |
| −0.247 | 0.196 | 3.565 |
| −0.253 | 0.203 | 3.565 |
| −0.260 | 0.211 | 3.565 |
| −0.266 | 0.218 | 3.565 |
| −0.267 | 0.219 | 3.565 |
| −0.268 | 0.221 | 3.565 |
| −0.270 | 0.222 | 3.565 |
| −0.271 | 0.224 | 3.565 |
| −0.272 | 0.225 | 3.565 |
| −0.273 | 0.227 | 3.565 |
| −0.274 | 0.228 | 3.565 |
| −0.276 | 0.230 | 3.565 |
| −0.277 | 0.231 | 3.565 |
| −0.278 | 0.233 | 3.565 |
| −0.262 | 0.251 | 3.565 |
| −0.263 | 0.252 | 3.565 |
| −0.265 | 0.253 | 3.565 |
| −0.267 | 0.253 | 3.565 |
| −0.269 | 0.253 | 3.565 |
| −0.271 | 0.253 | 3.565 |
| −0.273 | 0.252 | 3.565 |
| −0.275 | 0.252 | 3.565 |
| −0.276 | 0.251 | 3.565 |
| −0.278 | 0.249 | 3.565 |
| −0.279 | 0.248 | 3.565 |
| −0.280 | 0.246 | 3.565 |
| −0.281 | 0.244 | 3.565 |
| −0.281 | 0.242 | 3.565 |
| −0.281 | 0.240 | 3.565 |
| −0.281 | 0.238 | 3.565 |
| −0.280 | 0.236 | 3.565 |
| −0.279 | 0.234 | 3.565 |
| 0.372 | −0.031 | 3.565 |
| 0.370 | −0.031 | 3.565 |
| 0.368 | −0.031 | 3.565 |
| 0.367 | −0.031 | 3.565 |
| 0.365 | −0.032 | 3.565 |
| 0.363 | −0.032 | 3.565 |
| 0.362 | −0.032 | 3.565 |
| 0.360 | −0.032 | 3.565 |
| 0.358 | −0.032 | 3.565 |
| 0.356 | −0.033 | 3.565 |
| 0.355 | −0.033 | 3.565 |
| 0.346 | −0.034 | 3.565 |
| 0.338 | −0.035 | 3.565 |
| 0.329 | −0.035 | 3.565 |
| 0.320 | −0.036 | 3.565 |
| 0.312 | −0.036 | 3.565 |
| 0.303 | −0.036 | 3.565 |
| 0.294 | −0.036 | 3.565 |
| 0.286 | −0.036 | 3.565 |
| 0.277 | −0.036 | 3.565 |
| 0.268 | −0.036 | 3.565 |
| 0.260 | −0.035 | 3.565 |
| 0.251 | −0.035 | 3.565 |
| 0.243 | −0.034 | 3.565 |
| 0.234 | −0.033 | 3.565 |
| 0.225 | −0.032 | 3.565 |
| 0.217 | −0.031 | 3.565 |
| 0.208 | −0.029 | 3.565 |
| 0.200 | −0.028 | 3.565 |
| 0.191 | −0.026 | 3.565 |
| 0.183 | −0.025 | 3.565 |
| 0.174 | −0.023 | 3.565 |

TABLE 2-continued

| X | Y | Z |
|---|---|---|
| 0.166 | −0.021 | 3.565 |
| 0.158 | −0.018 | 3.565 |
| 0.149 | −0.016 | 3.565 |
| 0.141 | −0.014 | 3.565 |
| 0.133 | −0.011 | 3.565 |
| 0.124 | −0.009 | 3.565 |
| 0.116 | −0.006 | 3.565 |
| 0.108 | −0.003 | 3.565 |
| 0.100 | 0.000 | 3.565 |
| 0.092 | 0.003 | 3.565 |
| 0.084 | 0.007 | 3.565 |
| 0.076 | 0.010 | 3.565 |
| 0.068 | 0.013 | 3.565 |
| 0.060 | 0.017 | 3.565 |
| 0.052 | 0.020 | 3.565 |
| 0.044 | 0.024 | 3.565 |
| 0.037 | 0.028 | 3.565 |
| 0.029 | 0.032 | 3.565 |
| 0.021 | 0.036 | 3.565 |
| 0.014 | 0.040 | 3.565 |
| 0.006 | 0.044 | 3.565 |
| −0.002 | 0.048 | 3.565 |
| −0.009 | 0.053 | 3.565 |
| −0.016 | 0.057 | 3.565 |
| −0.024 | 0.061 | 3.565 |
| −0.031 | 0.066 | 3.565 |
| −0.039 | 0.070 | 3.565 |
| −0.046 | 0.075 | 3.565 |
| −0.053 | 0.080 | 3.565 |
| −0.060 | 0.085 | 3.565 |
| −0.068 | 0.089 | 3.565 |
| −0.075 | 0.094 | 3.565 |
| −0.082 | 0.099 | 3.565 |
| −0.089 | 0.104 | 3.565 |
| −0.096 | 0.109 | 3.565 |
| −0.103 | 0.114 | 3.565 |
| −0.110 | 0.120 | 3.565 |
| −0.117 | 0.125 | 3.565 |
| −0.124 | 0.130 | 3.565 |
| −0.130 | 0.135 | 3.565 |
| −0.137 | 0.141 | 3.565 |
| −0.144 | 0.146 | 3.565 |
| −0.151 | 0.152 | 3.565 |
| −0.157 | 0.157 | 3.565 |
| −0.164 | 0.163 | 3.565 |
| −0.170 | 0.168 | 3.565 |
| −0.177 | 0.174 | 3.565 |
| −0.184 | 0.179 | 3.565 |
| −0.190 | 0.185 | 3.565 |
| −0.197 | 0.191 | 3.565 |
| −0.203 | 0.197 | 3.565 |
| −0.209 | 0.202 | 3.565 |
| −0.216 | 0.208 | 3.565 |
| −0.222 | 0.214 | 3.565 |
| −0.229 | 0.220 | 3.565 |
| −0.235 | 0.226 | 3.565 |
| −0.241 | 0.232 | 3.565 |
| −0.247 | 0.238 | 3.565 |
| −0.249 | 0.239 | 3.565 |
| −0.250 | 0.240 | 3.565 |
| −0.251 | 0.241 | 3.565 |
| −0.252 | 0.243 | 3.565 |
| −0.254 | 0.244 | 3.565 |
| −0.255 | 0.245 | 3.565 |
| −0.256 | 0.246 | 3.565 |
| −0.257 | 0.247 | 3.565 |
| −0.259 | 0.249 | 3.565 |
| −0.260 | 0.250 | 3.565 |
| 0.375 | −0.030 | 3.565 |
| 0.379 | −0.030 | 3.565 |
| 0.382 | −0.030 | 3.565 |
| 0.386 | −0.031 | 3.565 |
| 0.389 | −0.032 | 3.565 |
| 0.392 | −0.033 | 3.565 |
| 0.395 | −0.035 | 3.565 |
| 0.398 | −0.038 | 3.565 |
| 0.400 | −0.041 | 3.565 |
| 0.401 | −0.044 | 3.565 |

TABLE 2-continued

| X | Y | Z |
|---|---|---|
| 0.402 | −0.048 | 3.565 |
| 0.401 | −0.051 | 3.565 |
| 0.400 | −0.054 | 3.565 |
| 0.399 | −0.058 | 3.565 |
| 0.397 | −0.061 | 3.565 |
| 0.395 | −0.063 | 3.565 |
| 0.393 | −0.066 | 3.565 |
| 0.390 | −0.068 | 3.565 |
| SECTION 3 | | |
| 0.393 | −0.091 | 3.835 |
| 0.391 | −0.092 | 3.835 |
| 0.389 | −0.093 | 3.835 |
| 0.387 | −0.094 | 3.835 |
| 0.385 | −0.095 | 3.835 |
| 0.384 | −0.096 | 3.835 |
| 0.382 | −0.096 | 3.835 |
| 0.380 | −0.097 | 3.835 |
| 0.378 | −0.098 | 3.835 |
| 0.376 | −0.099 | 3.835 |
| 0.374 | −0.100 | 3.835 |
| 0.365 | −0.104 | 3.835 |
| 0.356 | −0.108 | 3.835 |
| 0.346 | −0.112 | 3.835 |
| 0.336 | −0.115 | 3.835 |
| 0.327 | −0.118 | 3.835 |
| 0.317 | −0.121 | 3.835 |
| 0.307 | −0.123 | 3.835 |
| 0.297 | −0.125 | 3.835 |
| 0.286 | −0.127 | 3.835 |
| 0.276 | −0.128 | 3.835 |
| 0.266 | −0.129 | 3.835 |
| 0.256 | −0.129 | 3.835 |
| 0.246 | −0.130 | 3.835 |
| 0.235 | −0.130 | 3.835 |
| 0.225 | −0.129 | 3.835 |
| 0.215 | −0.128 | 3.835 |
| 0.205 | −0.127 | 3.835 |
| 0.194 | −0.126 | 3.835 |
| 0.184 | −0.124 | 3.835 |
| 0.174 | −0.122 | 3.835 |
| 0.164 | −0.120 | 3.835 |
| 0.154 | −0.118 | 3.835 |
| 0.144 | −0.115 | 3.835 |
| 0.135 | −0.112 | 3.835 |
| 0.125 | −0.108 | 3.835 |
| 0.115 | −0.105 | 3.835 |
| 0.106 | −0.101 | 3.835 |
| 0.096 | −0.097 | 3.835 |
| 0.087 | −0.093 | 3.835 |
| 0.078 | −0.089 | 3.835 |
| 0.068 | −0.084 | 3.835 |
| 0.059 | −0.079 | 3.835 |
| 0.050 | −0.074 | 3.835 |
| 0.041 | −0.069 | 3.835 |
| 0.033 | −0.064 | 3.835 |
| 0.024 | −0.059 | 3.835 |
| 0.015 | −0.053 | 3.835 |
| 0.007 | −0.047 | 3.835 |
| −0.002 | −0.042 | 3.835 |
| −0.010 | −0.036 | 3.835 |
| −0.018 | −0.030 | 3.835 |
| −0.027 | −0.024 | 3.835 |
| −0.035 | −0.017 | 3.835 |
| −0.043 | −0.011 | 3.835 |
| −0.051 | −0.005 | 3.835 |
| −0.059 | 0.002 | 3.835 |
| −0.067 | 0.009 | 3.835 |
| −0.074 | 0.015 | 3.835 |
| −0.082 | 0.022 | 3.835 |
| −0.090 | 0.029 | 3.835 |
| −0.097 | 0.036 | 3.835 |
| −0.105 | 0.043 | 3.835 |
| −0.112 | 0.050 | 3.835 |
| −0.120 | 0.057 | 3.835 |
| −0.127 | 0.064 | 3.835 |
| −0.134 | 0.071 | 3.835 |
| −0.142 | 0.078 | 3.835 |

TABLE 2-continued

| X | Y | Z |
|---|---|---|
| −0.149 | 0.085 | 3.835 |
| −0.156 | 0.093 | 3.835 |
| −0.163 | 0.100 | 3.835 |
| −0.170 | 0.108 | 3.835 |
| −0.177 | 0.115 | 3.835 |
| −0.184 | 0.123 | 3.835 |
| −0.191 | 0.130 | 3.835 |
| −0.198 | 0.138 | 3.835 |
| −0.205 | 0.146 | 3.835 |
| −0.212 | 0.153 | 3.835 |
| −0.218 | 0.161 | 3.835 |
| −0.225 | 0.169 | 3.835 |
| −0.232 | 0.177 | 3.835 |
| −0.238 | 0.184 | 3.835 |
| −0.245 | 0.192 | 3.835 |
| −0.251 | 0.200 | 3.835 |
| −0.258 | 0.208 | 3.835 |
| −0.264 | 0.216 | 3.835 |
| −0.271 | 0.224 | 3.835 |
| −0.277 | 0.232 | 3.835 |
| −0.283 | 0.240 | 3.835 |
| −0.290 | 0.248 | 3.835 |
| −0.291 | 0.250 | 3.835 |
| −0.292 | 0.252 | 3.835 |
| −0.293 | 0.253 | 3.835 |
| −0.295 | 0.255 | 3.835 |
| −0.296 | 0.257 | 3.835 |
| −0.297 | 0.258 | 3.835 |
| −0.298 | 0.260 | 3.835 |
| −0.300 | 0.261 | 3.835 |
| −0.301 | 0.263 | 3.835 |
| −0.302 | 0.265 | 3.835 |
| −0.303 | 0.266 | 3.835 |
| −0.304 | 0.268 | 3.835 |
| −0.305 | 0.270 | 3.835 |
| −0.305 | 0.272 | 3.835 |
| −0.305 | 0.274 | 3.835 |
| −0.304 | 0.276 | 3.835 |
| −0.304 | 0.278 | 3.835 |
| −0.303 | 0.280 | 3.835 |
| −0.301 | 0.281 | 3.835 |
| −0.300 | 0.282 | 3.835 |
| −0.298 | 0.283 | 3.835 |
| −0.296 | 0.284 | 3.835 |
| −0.294 | 0.285 | 3.835 |
| −0.292 | 0.285 | 3.835 |
| −0.290 | 0.285 | 3.835 |
| −0.288 | 0.284 | 3.835 |
| −0.287 | 0.283 | 3.835 |
| −0.285 | 0.282 | 3.835 |
| −0.283 | 0.281 | 3.835 |
| −0.282 | 0.280 | 3.835 |
| −0.281 | 0.278 | 3.835 |
| −0.280 | 0.277 | 3.835 |
| −0.278 | 0.276 | 3.835 |
| −0.277 | 0.274 | 3.835 |
| −0.276 | 0.273 | 3.835 |
| −0.274 | 0.272 | 3.835 |
| −0.273 | 0.270 | 3.835 |
| −0.272 | 0.269 | 3.835 |
| −0.271 | 0.268 | 3.835 |
| −0.264 | 0.261 | 3.835 |
| −0.258 | 0.254 | 3.835 |
| −0.251 | 0.248 | 3.835 |
| −0.245 | 0.241 | 3.835 |
| −0.238 | 0.235 | 3.835 |
| −0.232 | 0.228 | 3.835 |
| −0.225 | 0.222 | 3.835 |
| −0.218 | 0.215 | 3.835 |
| −0.212 | 0.209 | 3.835 |
| −0.205 | 0.202 | 3.835 |
| −0.198 | 0.196 | 3.835 |
| −0.192 | 0.190 | 3.835 |
| −0.185 | 0.183 | 3.835 |
| −0.178 | 0.177 | 3.835 |
| −0.171 | 0.171 | 3.835 |
| −0.164 | 0.165 | 3.835 |
| −0.157 | 0.159 | 3.835 |

TABLE 2-continued

| X | Y | Z |
|---|---|---|
| −0.150 | 0.153 | 3.835 |
| −0.143 | 0.147 | 3.835 |
| −0.136 | 0.141 | 3.835 |
| −0.129 | 0.135 | 3.835 |
| −0.122 | 0.129 | 3.835 |
| −0.114 | 0.124 | 3.835 |
| −0.107 | 0.118 | 3.835 |
| −0.100 | 0.112 | 3.835 |
| −0.092 | 0.107 | 3.835 |
| −0.085 | 0.101 | 3.835 |
| −0.077 | 0.096 | 3.835 |
| −0.070 | 0.091 | 3.835 |
| −0.062 | 0.085 | 3.835 |
| −0.054 | 0.080 | 3.835 |
| −0.047 | 0.075 | 3.835 |
| −0.039 | 0.070 | 3.835 |
| −0.031 | 0.065 | 3.835 |
| −0.023 | 0.060 | 3.835 |
| −0.015 | 0.055 | 3.835 |
| −0.008 | 0.051 | 3.835 |
| 0.000 | 0.046 | 3.835 |
| 0.009 | 0.041 | 3.835 |
| 0.017 | 0.037 | 3.835 |
| 0.025 | 0.033 | 3.835 |
| 0.033 | 0.028 | 3.835 |
| 0.041 | 0.024 | 3.835 |
| 0.049 | 0.020 | 3.835 |
| 0.058 | 0.016 | 3.835 |
| 0.066 | 0.012 | 3.835 |
| 0.075 | 0.008 | 3.835 |
| 0.083 | 0.005 | 3.835 |
| 0.092 | 0.001 | 3.835 |
| 0.100 | −0.002 | 3.835 |
| 0.109 | −0.006 | 3.835 |
| 0.117 | −0.009 | 3.835 |
| 0.126 | −0.012 | 3.835 |
| 0.135 | −0.015 | 3.835 |
| 0.144 | −0.018 | 3.835 |
| 0.152 | −0.021 | 3.835 |
| 0.161 | −0.024 | 3.835 |
| 0.170 | −0.026 | 3.835 |
| 0.179 | −0.029 | 3.835 |
| 0.188 | −0.031 | 3.835 |
| 0.197 | −0.034 | 3.835 |
| 0.206 | −0.036 | 3.835 |
| 0.215 | −0.038 | 3.835 |
| 0.224 | −0.039 | 3.835 |
| 0.233 | −0.041 | 3.835 |
| 0.242 | −0.043 | 3.835 |
| 0.251 | −0.044 | 3.835 |
| 0.261 | −0.045 | 3.835 |
| 0.270 | −0.047 | 3.835 |
| 0.279 | −0.048 | 3.835 |
| 0.288 | −0.048 | 3.835 |
| 0.297 | −0.049 | 3.835 |
| 0.307 | −0.050 | 3.835 |
| 0.316 | −0.050 | 3.835 |
| 0.325 | −0.051 | 3.835 |
| 0.334 | −0.051 | 3.835 |
| 0.344 | −0.051 | 3.835 |
| 0.353 | −0.051 | 3.835 |
| 0.362 | −0.051 | 3.835 |
| 0.364 | −0.051 | 3.835 |
| 0.366 | −0.051 | 3.835 |
| 0.368 | −0.050 | 3.835 |
| 0.369 | −0.050 | 3.835 |
| 0.371 | −0.050 | 3.835 |
| 0.373 | −0.050 | 3.835 |
| 0.375 | −0.050 | 3.835 |
| 0.377 | −0.050 | 3.835 |
| 0.379 | −0.050 | 3.835 |
| 0.381 | −0.050 | 3.835 |
| 0.384 | −0.050 | 3.835 |
| 0.388 | −0.050 | 3.835 |
| 0.391 | −0.051 | 3.835 |
| 0.394 | −0.051 | 3.835 |
| 0.398 | −0.053 | 3.835 |
| 0.401 | −0.054 | 3.835 |

TABLE 2-continued

| | X | Y | Z |
|---|---|---|---|
| | 0.404 | −0.057 | 3.835 |
| | 0.406 | −0.059 | 3.835 |
| | 0.408 | −0.062 | 3.835 |
| | 0.409 | −0.066 | 3.835 |
| | 0.409 | −0.069 | 3.835 |
| | 0.408 | −0.073 | 3.835 |
| | 0.407 | −0.076 | 3.835 |
| | 0.406 | −0.079 | 3.835 |
| | 0.404 | −0.082 | 3.835 |
| | 0.401 | −0.084 | 3.835 |
| | 0.399 | −0.087 | 3.835 |
| | 0.396 | −0.089 | 3.835 |
| SECTION 4 | | | |
| | 0.401 | −0.104 | 4.105 |
| | 0.399 | −0.105 | 4.105 |
| | 0.397 | −0.106 | 4.105 |
| | 0.395 | −0.107 | 4.105 |
| | 0.393 | −0.108 | 4.105 |
| | 0.391 | −0.109 | 4.105 |
| | 0.389 | −0.110 | 4.105 |
| | 0.387 | −0.111 | 4.105 |
| | 0.385 | −0.112 | 4.105 |
| | 0.383 | −0.112 | 4.105 |
| | 0.381 | −0.113 | 4.105 |
| | 0.371 | −0.118 | 4.105 |
| | 0.361 | −0.122 | 4.105 |
| | 0.350 | −0.125 | 4.105 |
| | 0.340 | −0.128 | 4.105 |
| | 0.329 | −0.131 | 4.105 |
| | 0.319 | −0.134 | 4.105 |
| | 0.308 | −0.136 | 4.105 |
| | 0.297 | −0.138 | 4.105 |
| | 0.286 | −0.139 | 4.105 |
| | 0.275 | −0.140 | 4.105 |
| | 0.264 | −0.141 | 4.105 |
| | 0.253 | −0.142 | 4.105 |
| | 0.242 | −0.142 | 4.105 |
| | 0.231 | −0.141 | 4.105 |
| | 0.220 | −0.141 | 4.105 |
| | 0.209 | −0.139 | 4.105 |
| | 0.198 | −0.138 | 4.105 |
| | 0.188 | −0.136 | 4.105 |
| | 0.177 | −0.134 | 4.105 |
| | 0.166 | −0.132 | 4.105 |
| | 0.155 | −0.130 | 4.105 |
| | 0.145 | −0.127 | 4.105 |
| | 0.134 | −0.123 | 4.105 |
| | 0.124 | −0.120 | 4.105 |
| | 0.114 | −0.116 | 4.105 |
| | 0.103 | −0.112 | 4.105 |
| | 0.093 | −0.108 | 4.105 |
| | 0.083 | −0.104 | 4.105 |
| | 0.073 | −0.099 | 4.105 |
| | 0.063 | −0.094 | 4.105 |
| | 0.054 | −0.089 | 4.105 |
| | 0.044 | −0.084 | 4.105 |
| | 0.034 | −0.078 | 4.105 |
| | 0.025 | −0.073 | 4.105 |
| | 0.016 | −0.067 | 4.105 |
| | 0.007 | −0.061 | 4.105 |
| | −0.002 | −0.054 | 4.105 |
| | −0.011 | −0.048 | 4.105 |
| | −0.020 | −0.042 | 4.105 |
| | −0.029 | −0.035 | 4.105 |
| | −0.038 | −0.028 | 4.105 |
| | −0.046 | −0.022 | 4.105 |
| | −0.055 | −0.015 | 4.105 |
| | −0.063 | −0.008 | 4.105 |
| | −0.072 | 0.000 | 4.105 |
| | −0.080 | 0.007 | 4.105 |
| | −0.088 | 0.014 | 4.105 |
| | −0.096 | 0.022 | 4.105 |
| | −0.104 | 0.029 | 4.105 |
| | −0.112 | 0.037 | 4.105 |
| | −0.120 | 0.044 | 4.105 |
| | −0.128 | 0.052 | 4.105 |
| | −0.136 | 0.060 | 4.105 |

TABLE 2-continued

| | X | Y | Z |
|---|---|---|---|
| | −0.143 | 0.068 | 4.105 |
| | −0.151 | 0.076 | 4.105 |
| | −0.158 | 0.084 | 4.105 |
| | −0.166 | 0.092 | 4.105 |
| | −0.173 | 0.100 | 4.105 |
| | −0.180 | 0.108 | 4.105 |
| | −0.188 | 0.116 | 4.105 |
| | −0.195 | 0.125 | 4.105 |
| | −0.202 | 0.133 | 4.105 |
| | −0.209 | 0.141 | 4.105 |
| | −0.216 | 0.150 | 4.105 |
| | −0.223 | 0.158 | 4.105 |
| | −0.230 | 0.167 | 4.105 |
| | −0.237 | 0.175 | 4.105 |
| | −0.244 | 0.184 | 4.105 |
| | −0.251 | 0.193 | 4.105 |
| | −0.257 | 0.201 | 4.105 |
| | −0.264 | 0.210 | 4.105 |
| | −0.271 | 0.219 | 4.105 |
| | −0.277 | 0.227 | 4.105 |
| | −0.284 | 0.236 | 4.105 |
| | −0.291 | 0.245 | 4.105 |
| | −0.297 | 0.254 | 4.105 |
| | −0.304 | 0.263 | 4.105 |
| | −0.310 | 0.272 | 4.105 |
| | −0.317 | 0.280 | 4.105 |
| | −0.318 | 0.282 | 4.105 |
| | −0.319 | 0.284 | 4.105 |
| | −0.320 | 0.286 | 4.105 |
| | −0.322 | 0.288 | 4.105 |
| | −0.323 | 0.289 | 4.105 |
| | −0.324 | 0.291 | 4.105 |
| | −0.325 | 0.293 | 4.105 |
| | −0.327 | 0.295 | 4.105 |
| | −0.328 | 0.297 | 4.105 |
| | −0.329 | 0.298 | 4.105 |
| | −0.330 | 0.300 | 4.105 |
| | −0.331 | 0.302 | 4.105 |
| | −0.332 | 0.304 | 4.105 |
| | −0.332 | 0.306 | 4.105 |
| | −0.331 | 0.308 | 4.105 |
| | −0.331 | 0.310 | 4.105 |
| | −0.330 | 0.312 | 4.105 |
| | −0.329 | 0.313 | 4.105 |
| | −0.328 | 0.315 | 4.105 |
| | −0.326 | 0.316 | 4.105 |
| | −0.325 | 0.317 | 4.105 |
| | −0.323 | 0.318 | 4.105 |
| | −0.321 | 0.318 | 4.105 |
| | −0.319 | 0.318 | 4.105 |
| | −0.317 | 0.318 | 4.105 |
| | −0.315 | 0.317 | 4.105 |
| | −0.313 | 0.317 | 4.105 |
| | −0.311 | 0.315 | 4.105 |
| | −0.310 | 0.314 | 4.105 |
| | −0.309 | 0.313 | 4.105 |
| | −0.307 | 0.311 | 4.105 |
| | −0.306 | 0.310 | 4.105 |
| | −0.305 | 0.308 | 4.105 |
| | −0.303 | 0.307 | 4.105 |
| | −0.302 | 0.305 | 4.105 |
| | −0.301 | 0.304 | 4.105 |
| | −0.299 | 0.302 | 4.105 |
| | −0.298 | 0.301 | 4.105 |
| | −0.297 | 0.299 | 4.105 |
| | −0.290 | 0.292 | 4.105 |
| | −0.283 | 0.284 | 4.105 |
| | −0.277 | 0.277 | 4.105 |
| | −0.270 | 0.270 | 4.105 |
| | −0.263 | 0.262 | 4.105 |
| | −0.257 | 0.255 | 4.105 |
| | −0.250 | 0.248 | 4.105 |
| | −0.243 | 0.241 | 4.105 |
| | −0.236 | 0.233 | 4.105 |
| | −0.230 | 0.226 | 4.105 |
| | −0.223 | 0.219 | 4.105 |
| | −0.216 | 0.212 | 4.105 |
| | −0.209 | 0.205 | 4.105 |

TABLE 2-continued

| X | Y | Z |
|---|---|---|
| −0.202 | 0.198 | 4.105 |
| −0.195 | 0.191 | 4.105 |
| −0.187 | 0.184 | 4.105 |
| −0.180 | 0.177 | 4.105 |
| −0.173 | 0.170 | 4.105 |
| −0.166 | 0.164 | 4.105 |
| −0.158 | 0.157 | 4.105 |
| −0.151 | 0.150 | 4.105 |
| −0.143 | 0.144 | 4.105 |
| −0.136 | 0.137 | 4.105 |
| −0.128 | 0.131 | 4.105 |
| −0.121 | 0.125 | 4.105 |
| −0.113 | 0.118 | 4.105 |
| −0.105 | 0.112 | 4.105 |
| −0.097 | 0.106 | 4.105 |
| −0.090 | 0.100 | 4.105 |
| −0.082 | 0.094 | 4.105 |
| −0.074 | 0.088 | 4.105 |
| −0.065 | 0.082 | 4.105 |
| −0.057 | 0.077 | 4.105 |
| −0.049 | 0.071 | 4.105 |
| −0.041 | 0.066 | 4.105 |
| −0.033 | 0.060 | 4.105 |
| −0.024 | 0.055 | 4.105 |
| −0.016 | 0.050 | 4.105 |
| −0.007 | 0.044 | 4.105 |
| 0.001 | 0.039 | 4.105 |
| 0.010 | 0.034 | 4.105 |
| 0.019 | 0.030 | 4.105 |
| 0.027 | 0.025 | 4.105 |
| 0.036 | 0.020 | 4.105 |
| 0.045 | 0.016 | 4.105 |
| 0.054 | 0.011 | 4.105 |
| 0.063 | 0.007 | 4.105 |
| 0.072 | 0.003 | 4.105 |
| 0.081 | −0.001 | 4.105 |
| 0.090 | −0.005 | 4.105 |
| 0.099 | −0.009 | 4.105 |
| 0.108 | −0.013 | 4.105 |
| 0.117 | −0.016 | 4.105 |
| 0.127 | −0.020 | 4.105 |
| 0.136 | −0.023 | 4.105 |
| 0.145 | −0.027 | 4.105 |
| 0.155 | −0.030 | 4.105 |
| 0.164 | −0.033 | 4.105 |
| 0.174 | −0.036 | 4.105 |
| 0.183 | −0.038 | 4.105 |
| 0.193 | −0.041 | 4.105 |
| 0.203 | −0.043 | 4.105 |
| 0.212 | −0.046 | 4.105 |
| 0.222 | −0.048 | 4.105 |
| 0.232 | −0.050 | 4.105 |
| 0.241 | −0.052 | 4.105 |
| 0.251 | −0.053 | 4.105 |
| 0.261 | −0.055 | 4.105 |
| 0.271 | −0.056 | 4.105 |
| 0.281 | −0.058 | 4.105 |
| 0.291 | −0.059 | 4.105 |
| 0.300 | −0.060 | 4.105 |
| 0.310 | −0.061 | 4.105 |
| 0.320 | −0.061 | 4.105 |
| 0.330 | −0.062 | 4.105 |
| 0.340 | −0.062 | 4.105 |
| 0.350 | −0.063 | 4.105 |
| 0.360 | −0.063 | 4.105 |
| 0.370 | −0.063 | 4.105 |
| 0.372 | −0.063 | 4.105 |
| 0.374 | −0.063 | 4.105 |
| 0.376 | −0.063 | 4.105 |
| 0.378 | −0.063 | 4.105 |
| 0.380 | −0.063 | 4.105 |
| 0.382 | −0.063 | 4.105 |
| 0.384 | −0.063 | 4.105 |
| 0.386 | −0.063 | 4.105 |
| 0.388 | −0.063 | 4.105 |
| 0.390 | −0.063 | 4.105 |
| 0.393 | −0.063 | 4.105 |
| 0.397 | −0.063 | 4.105 |

TABLE 2-continued

| X | Y | Z |
|---|---|---|
| 0.400 | −0.064 | 4.105 |
| 0.404 | −0.065 | 4.105 |
| 0.407 | −0.066 | 4.105 |
| 0.410 | −0.068 | 4.105 |
| 0.413 | −0.070 | 4.105 |
| 0.415 | −0.073 | 4.105 |
| 0.417 | −0.076 | 4.105 |
| 0.418 | −0.079 | 4.105 |
| 0.418 | −0.083 | 4.105 |
| 0.417 | −0.086 | 4.105 |
| 0.416 | −0.089 | 4.105 |
| 0.414 | −0.092 | 4.105 |
| 0.412 | −0.095 | 4.105 |
| 0.409 | −0.098 | 4.105 |
| 0.407 | −0.100 | 4.105 |
| 0.404 | −0.102 | 4.105 |
| SECTION 5 | | |
| 0.411 | −0.112 | 4.375 |
| 0.409 | −0.113 | 4.375 |
| 0.407 | −0.114 | 4.375 |
| 0.405 | −0.116 | 4.375 |
| 0.403 | −0.117 | 4.375 |
| 0.400 | −0.118 | 4.375 |
| 0.398 | −0.119 | 4.375 |
| 0.396 | −0.120 | 4.375 |
| 0.394 | −0.121 | 4.375 |
| 0.392 | −0.122 | 4.375 |
| 0.390 | −0.123 | 4.375 |
| 0.379 | −0.128 | 4.375 |
| 0.368 | −0.132 | 4.375 |
| 0.357 | −0.136 | 4.375 |
| 0.346 | −0.139 | 4.375 |
| 0.334 | −0.142 | 4.375 |
| 0.323 | −0.145 | 4.375 |
| 0.312 | −0.147 | 4.375 |
| 0.300 | −0.149 | 4.375 |
| 0.288 | −0.151 | 4.375 |
| 0.277 | −0.152 | 4.375 |
| 0.265 | −0.152 | 4.375 |
| 0.253 | −0.153 | 4.375 |
| 0.241 | −0.153 | 4.375 |
| 0.230 | −0.152 | 4.375 |
| 0.218 | −0.151 | 4.375 |
| 0.206 | −0.150 | 4.375 |
| 0.194 | −0.149 | 4.375 |
| 0.183 | −0.147 | 4.375 |
| 0.171 | −0.144 | 4.375 |
| 0.160 | −0.142 | 4.375 |
| 0.148 | −0.139 | 4.375 |
| 0.137 | −0.136 | 4.375 |
| 0.126 | −0.132 | 4.375 |
| 0.115 | −0.128 | 4.375 |
| 0.104 | −0.124 | 4.375 |
| 0.093 | −0.120 | 4.375 |
| 0.082 | −0.115 | 4.375 |
| 0.071 | −0.110 | 4.375 |
| 0.061 | −0.105 | 4.375 |
| 0.050 | −0.099 | 4.375 |
| 0.040 | −0.094 | 4.375 |
| 0.030 | −0.088 | 4.375 |
| 0.020 | −0.082 | 4.375 |
| 0.010 | −0.076 | 4.375 |
| 0.000 | −0.069 | 4.375 |
| −0.010 | −0.063 | 4.375 |
| −0.019 | −0.056 | 4.375 |
| −0.029 | −0.049 | 4.375 |
| −0.038 | −0.042 | 4.375 |
| −0.047 | −0.034 | 4.375 |
| −0.056 | −0.027 | 4.375 |
| −0.065 | −0.019 | 4.375 |
| −0.074 | −0.012 | 4.375 |
| −0.083 | −0.004 | 4.375 |
| −0.092 | 0.004 | 4.375 |
| −0.100 | 0.012 | 4.375 |
| −0.109 | 0.020 | 4.375 |
| −0.117 | 0.028 | 4.375 |
| −0.126 | 0.037 | 4.375 |

TABLE 2-continued

| X | Y | Z |
|---|---|---|
| −0.134 | 0.045 | 4.375 |
| −0.142 | 0.053 | 4.375 |
| −0.150 | 0.062 | 4.375 |
| −0.158 | 0.071 | 4.375 |
| −0.166 | 0.079 | 4.375 |
| −0.174 | 0.088 | 4.375 |
| −0.182 | 0.097 | 4.375 |
| −0.190 | 0.106 | 4.375 |
| −0.197 | 0.115 | 4.375 |
| −0.205 | 0.124 | 4.375 |
| −0.212 | 0.133 | 4.375 |
| −0.220 | 0.142 | 4.375 |
| −0.227 | 0.151 | 4.375 |
| −0.234 | 0.160 | 4.375 |
| −0.241 | 0.170 | 4.375 |
| −0.249 | 0.179 | 4.375 |
| −0.256 | 0.188 | 4.375 |
| −0.263 | 0.198 | 4.375 |
| −0.270 | 0.207 | 4.375 |
| −0.277 | 0.217 | 4.375 |
| −0.284 | 0.226 | 4.375 |
| −0.291 | 0.236 | 4.375 |
| −0.297 | 0.245 | 4.375 |
| −0.304 | 0.255 | 4.375 |
| −0.311 | 0.265 | 4.375 |
| −0.318 | 0.274 | 4.375 |
| −0.324 | 0.284 | 4.375 |
| −0.331 | 0.294 | 4.375 |
| −0.338 | 0.303 | 4.375 |
| −0.344 | 0.313 | 4.375 |
| −0.346 | 0.315 | 4.375 |
| −0.347 | 0.317 | 4.375 |
| −0.348 | 0.319 | 4.375 |
| −0.349 | 0.321 | 4.375 |
| −0.351 | 0.323 | 4.375 |
| −0.352 | 0.325 | 4.375 |
| −0.353 | 0.327 | 4.375 |
| −0.355 | 0.329 | 4.375 |
| −0.356 | 0.331 | 4.375 |
| −0.357 | 0.333 | 4.375 |
| −0.358 | 0.334 | 4.375 |
| −0.359 | 0.336 | 4.375 |
| −0.359 | 0.338 | 4.375 |
| −0.359 | 0.340 | 4.375 |
| −0.359 | 0.342 | 4.375 |
| −0.359 | 0.344 | 4.375 |
| −0.358 | 0.346 | 4.375 |
| −0.357 | 0.347 | 4.375 |
| −0.355 | 0.349 | 4.375 |
| −0.354 | 0.350 | 4.375 |
| −0.352 | 0.351 | 4.375 |
| −0.350 | 0.352 | 4.375 |
| −0.348 | 0.352 | 4.375 |
| −0.346 | 0.352 | 4.375 |
| −0.344 | 0.352 | 4.375 |
| −0.342 | 0.351 | 4.375 |
| −0.340 | 0.350 | 4.375 |
| −0.339 | 0.349 | 4.375 |
| −0.337 | 0.348 | 4.375 |
| −0.336 | 0.346 | 4.375 |
| −0.335 | 0.344 | 4.375 |
| −0.333 | 0.343 | 4.375 |
| −0.332 | 0.341 | 4.375 |
| −0.331 | 0.339 | 4.375 |
| −0.329 | 0.338 | 4.375 |
| −0.328 | 0.336 | 4.375 |
| −0.326 | 0.335 | 4.375 |
| −0.325 | 0.333 | 4.375 |
| −0.324 | 0.331 | 4.375 |
| −0.317 | 0.323 | 4.375 |
| −0.310 | 0.315 | 4.375 |
| −0.303 | 0.307 | 4.375 |
| −0.296 | 0.299 | 4.375 |
| −0.290 | 0.290 | 4.375 |
| −0.283 | 0.282 | 4.375 |
| −0.276 | 0.274 | 4.375 |
| −0.269 | 0.266 | 4.375 |
| −0.262 | 0.258 | 4.375 |

TABLE 2-continued

| X | Y | Z |
|---|---|---|
| −0.255 | 0.250 | 4.375 |
| −0.248 | 0.242 | 4.375 |
| −0.241 | 0.234 | 4.375 |
| −0.233 | 0.226 | 4.375 |
| −0.226 | 0.219 | 4.375 |
| −0.219 | 0.211 | 4.375 |
| −0.212 | 0.203 | 4.375 |
| −0.204 | 0.195 | 4.375 |
| −0.197 | 0.188 | 4.375 |
| −0.189 | 0.180 | 4.375 |
| −0.182 | 0.173 | 4.375 |
| −0.174 | 0.165 | 4.375 |
| −0.166 | 0.158 | 4.375 |
| −0.159 | 0.151 | 4.375 |
| −0.151 | 0.144 | 4.375 |
| −0.143 | 0.137 | 4.375 |
| −0.135 | 0.129 | 4.375 |
| −0.127 | 0.123 | 4.375 |
| −0.119 | 0.116 | 4.375 |
| −0.110 | 0.109 | 4.375 |
| −0.102 | 0.102 | 4.375 |
| −0.094 | 0.096 | 4.375 |
| −0.085 | 0.089 | 4.375 |
| −0.077 | 0.083 | 4.375 |
| −0.068 | 0.076 | 4.375 |
| −0.060 | 0.070 | 4.375 |
| −0.051 | 0.064 | 4.375 |
| −0.042 | 0.058 | 4.375 |
| −0.033 | 0.052 | 4.375 |
| −0.024 | 0.046 | 4.375 |
| −0.015 | 0.041 | 4.375 |
| −0.006 | 0.035 | 4.375 |
| 0.003 | 0.030 | 4.375 |
| 0.012 | 0.024 | 4.375 |
| 0.021 | 0.019 | 4.375 |
| 0.031 | 0.014 | 4.375 |
| 0.040 | 0.009 | 4.375 |
| 0.049 | 0.004 | 4.375 |
| 0.059 | −0.001 | 4.375 |
| 0.069 | −0.005 | 4.375 |
| 0.078 | −0.010 | 4.375 |
| 0.088 | −0.014 | 4.375 |
| 0.098 | −0.018 | 4.375 |
| 0.108 | −0.022 | 4.375 |
| 0.117 | −0.026 | 4.375 |
| 0.127 | −0.030 | 4.375 |
| 0.137 | −0.034 | 4.375 |
| 0.148 | −0.037 | 4.375 |
| 0.158 | −0.040 | 4.375 |
| 0.168 | −0.044 | 4.375 |
| 0.178 | −0.047 | 4.375 |
| 0.188 | −0.049 | 4.375 |
| 0.199 | −0.052 | 4.375 |
| 0.209 | −0.055 | 4.375 |
| 0.219 | −0.057 | 4.375 |
| 0.230 | −0.059 | 4.375 |
| 0.240 | −0.061 | 4.375 |
| 0.251 | −0.063 | 4.375 |
| 0.261 | −0.065 | 4.375 |
| 0.272 | −0.066 | 4.375 |
| 0.282 | −0.068 | 4.375 |
| 0.293 | −0.069 | 4.375 |
| 0.303 | −0.070 | 4.375 |
| 0.314 | −0.071 | 4.375 |
| 0.325 | −0.071 | 4.375 |
| 0.335 | −0.072 | 4.375 |
| 0.346 | −0.072 | 4.375 |
| 0.357 | −0.072 | 4.375 |
| 0.367 | −0.072 | 4.375 |
| 0.378 | −0.072 | 4.375 |
| 0.380 | −0.072 | 4.375 |
| 0.382 | −0.072 | 4.375 |
| 0.384 | −0.072 | 4.375 |
| 0.386 | −0.072 | 4.375 |
| 0.388 | −0.072 | 4.375 |
| 0.391 | −0.072 | 4.375 |
| 0.393 | −0.072 | 4.375 |
| 0.395 | −0.071 | 4.375 |

TABLE 2-continued

| | X | Y | Z |
|---|---|---|---|
| | 0.397 | −0.071 | 4.375 |
| | 0.399 | −0.071 | 4.375 |
| | 0.403 | −0.071 | 4.375 |
| | 0.406 | −0.071 | 4.375 |
| | 0.410 | −0.072 | 4.375 |
| | 0.413 | −0.073 | 4.375 |
| | 0.416 | −0.074 | 4.375 |
| | 0.419 | −0.076 | 4.375 |
| | 0.422 | −0.078 | 4.375 |
| | 0.425 | −0.081 | 4.375 |
| | 0.426 | −0.084 | 4.375 |
| | 0.427 | −0.087 | 4.375 |
| | 0.427 | −0.091 | 4.375 |
| | 0.427 | −0.094 | 4.375 |
| | 0.426 | −0.098 | 4.375 |
| | 0.424 | −0.101 | 4.375 |
| | 0.422 | −0.103 | 4.375 |
| | 0.419 | −0.106 | 4.375 |
| | 0.417 | −0.108 | 4.375 |
| | 0.414 | −0.110 | 4.375 |
| SECTION 6 | | | |
| | 0.422 | −0.121 | 4.645 |
| | 0.420 | −0.122 | 4.645 |
| | 0.418 | −0.124 | 4.645 |
| | 0.416 | −0.125 | 4.645 |
| | 0.413 | −0.126 | 4.645 |
| | 0.411 | −0.127 | 4.645 |
| | 0.409 | −0.128 | 4.645 |
| | 0.407 | −0.130 | 4.645 |
| | 0.404 | −0.131 | 4.645 |
| | 0.402 | −0.132 | 4.645 |
| | 0.400 | −0.133 | 4.645 |
| | 0.389 | −0.138 | 4.645 |
| | 0.377 | −0.143 | 4.645 |
| | 0.365 | −0.147 | 4.645 |
| | 0.353 | −0.151 | 4.645 |
| | 0.341 | −0.155 | 4.645 |
| | 0.329 | −0.158 | 4.645 |
| | 0.317 | −0.160 | 4.645 |
| | 0.304 | −0.163 | 4.645 |
| | 0.292 | −0.164 | 4.645 |
| | 0.279 | −0.165 | 4.645 |
| | 0.267 | −0.166 | 4.645 |
| | 0.254 | −0.167 | 4.645 |
| | 0.242 | −0.166 | 4.645 |
| | 0.229 | −0.166 | 4.645 |
| | 0.217 | −0.165 | 4.645 |
| | 0.204 | −0.164 | 4.645 |
| | 0.192 | −0.162 | 4.645 |
| | 0.180 | −0.160 | 4.645 |
| | 0.167 | −0.157 | 4.645 |
| | 0.155 | −0.154 | 4.645 |
| | 0.143 | −0.151 | 4.645 |
| | 0.131 | −0.147 | 4.645 |
| | 0.119 | −0.143 | 4.645 |
| | 0.107 | −0.139 | 4.645 |
| | 0.096 | −0.135 | 4.645 |
| | 0.084 | −0.130 | 4.645 |
| | 0.073 | −0.125 | 4.645 |
| | 0.061 | −0.119 | 4.645 |
| | 0.050 | −0.113 | 4.645 |
| | 0.039 | −0.107 | 4.645 |
| | 0.028 | −0.101 | 4.645 |
| | 0.017 | −0.095 | 4.645 |
| | 0.007 | −0.088 | 4.645 |
| | −0.004 | −0.081 | 4.645 |
| | −0.014 | −0.074 | 4.645 |
| | −0.024 | −0.067 | 4.645 |
| | −0.034 | −0.059 | 4.645 |
| | −0.044 | −0.052 | 4.645 |
| | −0.054 | −0.044 | 4.645 |
| | −0.064 | −0.036 | 4.645 |
| | −0.073 | −0.028 | 4.645 |
| | −0.083 | −0.019 | 4.645 |
| | −0.092 | −0.011 | 4.645 |
| | −0.101 | −0.002 | 4.645 |
| | −0.110 | 0.006 | 4.645 |

TABLE 2-continued

| X | Y | Z |
|---|---|---|
| −0.119 | 0.015 | 4.645 |
| −0.128 | 0.024 | 4.645 |
| −0.137 | 0.033 | 4.645 |
| −0.146 | 0.042 | 4.645 |
| −0.154 | 0.051 | 4.645 |
| −0.163 | 0.060 | 4.645 |
| −0.171 | 0.070 | 4.645 |
| −0.179 | 0.079 | 4.645 |
| −0.188 | 0.089 | 4.645 |
| −0.196 | 0.098 | 4.645 |
| −0.204 | 0.108 | 4.645 |
| −0.212 | 0.118 | 4.645 |
| −0.219 | 0.127 | 4.645 |
| −0.227 | 0.137 | 4.645 |
| −0.235 | 0.147 | 4.645 |
| −0.242 | 0.157 | 4.645 |
| −0.250 | 0.167 | 4.645 |
| −0.257 | 0.177 | 4.645 |
| −0.265 | 0.187 | 4.645 |
| −0.272 | 0.198 | 4.645 |
| −0.279 | 0.208 | 4.645 |
| −0.287 | 0.218 | 4.645 |
| −0.294 | 0.229 | 4.645 |
| −0.301 | 0.239 | 4.645 |
| −0.308 | 0.249 | 4.645 |
| −0.315 | 0.260 | 4.645 |
| −0.322 | 0.270 | 4.645 |
| −0.329 | 0.281 | 4.645 |
| −0.336 | 0.291 | 4.645 |
| −0.342 | 0.302 | 4.645 |
| −0.349 | 0.312 | 4.645 |
| −0.356 | 0.323 | 4.645 |
| −0.363 | 0.333 | 4.645 |
| −0.369 | 0.344 | 4.645 |
| −0.371 | 0.346 | 4.645 |
| −0.372 | 0.348 | 4.645 |
| −0.373 | 0.350 | 4.645 |
| −0.375 | 0.352 | 4.645 |
| −0.376 | 0.355 | 4.645 |
| −0.377 | 0.357 | 4.645 |
| −0.379 | 0.359 | 4.645 |
| −0.380 | 0.361 | 4.645 |
| −0.381 | 0.363 | 4.645 |
| −0.383 | 0.365 | 4.645 |
| −0.384 | 0.367 | 4.645 |
| −0.384 | 0.369 | 4.645 |
| −0.385 | 0.371 | 4.645 |
| −0.385 | 0.373 | 4.645 |
| −0.384 | 0.375 | 4.645 |
| −0.384 | 0.377 | 4.645 |
| −0.383 | 0.379 | 4.645 |
| −0.382 | 0.380 | 4.645 |
| −0.380 | 0.382 | 4.645 |
| −0.379 | 0.383 | 4.645 |
| −0.377 | 0.384 | 4.645 |
| −0.375 | 0.384 | 4.645 |
| −0.373 | 0.384 | 4.645 |
| −0.371 | 0.384 | 4.645 |
| −0.369 | 0.384 | 4.645 |
| −0.367 | 0.383 | 4.645 |
| −0.365 | 0.382 | 4.645 |
| −0.364 | 0.381 | 4.645 |
| −0.362 | 0.380 | 4.645 |
| −0.361 | 0.378 | 4.645 |
| −0.359 | 0.376 | 4.645 |
| −0.358 | 0.374 | 4.645 |
| −0.357 | 0.373 | 4.645 |
| −0.355 | 0.371 | 4.645 |
| −0.354 | 0.369 | 4.645 |
| −0.352 | 0.367 | 4.645 |
| −0.351 | 0.365 | 4.645 |
| −0.350 | 0.364 | 4.645 |
| −0.348 | 0.362 | 4.645 |
| −0.341 | 0.353 | 4.645 |
| −0.334 | 0.344 | 4.645 |
| −0.327 | 0.335 | 4.645 |
| −0.320 | 0.326 | 4.645 |
| −0.313 | 0.317 | 4.645 |

TABLE 2-continued

| X | Y | Z |
|---|---|---|
| −0.306 | 0.309 | 4.645 |
| −0.299 | 0.300 | 4.645 |
| −0.292 | 0.291 | 4.645 |
| −0.285 | 0.282 | 4.645 |
| −0.277 | 0.274 | 4.645 |
| −0.270 | 0.265 | 4.645 |
| −0.263 | 0.256 | 4.645 |
| −0.255 | 0.248 | 4.645 |
| −0.248 | 0.239 | 4.645 |
| −0.240 | 0.231 | 4.645 |
| −0.233 | 0.222 | 4.645 |
| −0.225 | 0.214 | 4.645 |
| −0.217 | 0.205 | 4.645 |
| −0.210 | 0.197 | 4.645 |
| −0.202 | 0.189 | 4.645 |
| −0.194 | 0.181 | 4.645 |
| −0.186 | 0.173 | 4.645 |
| −0.178 | 0.165 | 4.645 |
| −0.170 | 0.157 | 4.645 |
| −0.162 | 0.149 | 4.645 |
| −0.153 | 0.141 | 4.645 |
| −0.145 | 0.134 | 4.645 |
| −0.137 | 0.126 | 4.645 |
| −0.128 | 0.119 | 4.645 |
| −0.120 | 0.111 | 4.645 |
| −0.111 | 0.104 | 4.645 |
| −0.102 | 0.097 | 4.645 |
| −0.093 | 0.090 | 4.645 |
| −0.084 | 0.083 | 4.645 |
| −0.075 | 0.076 | 4.645 |
| −0.066 | 0.069 | 4.645 |
| −0.057 | 0.062 | 4.645 |
| −0.048 | 0.056 | 4.645 |
| −0.039 | 0.049 | 4.645 |
| −0.029 | 0.043 | 4.645 |
| −0.020 | 0.036 | 4.645 |
| −0.010 | 0.030 | 4.645 |
| −0.001 | 0.024 | 4.645 |
| 0.009 | 0.018 | 4.645 |
| 0.019 | 0.013 | 4.645 |
| 0.029 | 0.007 | 4.645 |
| 0.038 | 0.002 | 4.645 |
| 0.048 | −0.004 | 4.645 |
| 0.059 | −0.009 | 4.645 |
| 0.069 | −0.014 | 4.645 |
| 0.079 | −0.019 | 4.645 |
| 0.089 | −0.024 | 4.645 |
| 0.100 | −0.028 | 4.645 |
| 0.110 | −0.033 | 4.645 |
| 0.120 | −0.037 | 4.645 |
| 0.131 | −0.041 | 4.645 |
| 0.142 | −0.045 | 4.645 |
| 0.152 | −0.049 | 4.645 |
| 0.163 | −0.052 | 4.645 |
| 0.174 | −0.056 | 4.645 |
| 0.185 | −0.059 | 4.645 |
| 0.196 | −0.062 | 4.645 |
| 0.207 | −0.065 | 4.645 |
| 0.218 | −0.067 | 4.645 |
| 0.229 | −0.070 | 4.645 |
| 0.240 | −0.072 | 4.645 |
| 0.251 | −0.074 | 4.645 |
| 0.262 | −0.076 | 4.645 |
| 0.273 | −0.077 | 4.645 |
| 0.285 | −0.079 | 4.645 |
| 0.296 | −0.080 | 4.645 |
| 0.307 | −0.081 | 4.645 |
| 0.319 | −0.082 | 4.645 |
| 0.330 | −0.082 | 4.645 |
| 0.341 | −0.083 | 4.645 |
| 0.353 | −0.083 | 4.645 |
| 0.364 | −0.083 | 4.645 |
| 0.375 | −0.082 | 4.645 |
| 0.387 | −0.082 | 4.645 |
| 0.389 | −0.082 | 4.645 |
| 0.391 | −0.082 | 4.645 |
| 0.393 | −0.082 | 4.645 |
| 0.396 | −0.082 | 4.645 |

TABLE 2-continued

| X | Y | Z |
|---|---|---|
| 0.398 | −0.081 | 4.645 |
| 0.400 | −0.081 | 4.645 |
| 0.402 | −0.081 | 4.645 |
| 0.405 | −0.081 | 4.645 |
| 0.407 | −0.081 | 4.645 |
| 0.409 | −0.081 | 4.645 |
| 0.413 | −0.080 | 4.645 |
| 0.416 | −0.081 | 4.645 |
| 0.420 | −0.081 | 4.645 |
| 0.423 | −0.082 | 4.645 |
| 0.426 | −0.083 | 4.645 |
| 0.430 | −0.085 | 4.645 |
| 0.432 | −0.087 | 4.645 |
| 0.435 | −0.089 | 4.645 |
| 0.437 | −0.092 | 4.645 |
| 0.438 | −0.096 | 4.645 |
| 0.438 | −0.099 | 4.645 |
| 0.438 | −0.103 | 4.645 |
| 0.436 | −0.106 | 4.645 |
| 0.435 | −0.109 | 4.645 |
| 0.433 | −0.112 | 4.645 |
| 0.430 | −0.115 | 4.645 |
| 0.428 | −0.117 | 4.645 |
| 0.425 | −0.119 | 4.645 |
| SECTION 7 | | |
| 0.434 | −0.131 | 4.915 |
| 0.432 | −0.133 | 4.915 |
| 0.430 | −0.134 | 4.915 |
| 0.427 | −0.136 | 4.915 |
| 0.425 | −0.137 | 4.915 |
| 0.423 | −0.138 | 4.915 |
| 0.421 | −0.139 | 4.915 |
| 0.418 | −0.141 | 4.915 |
| 0.416 | −0.142 | 4.915 |
| 0.413 | −0.143 | 4.915 |
| 0.411 | −0.144 | 4.915 |
| 0.399 | −0.150 | 4.915 |
| 0.387 | −0.155 | 4.915 |
| 0.374 | −0.160 | 4.915 |
| 0.362 | −0.165 | 4.915 |
| 0.349 | −0.168 | 4.915 |
| 0.336 | −0.172 | 4.915 |
| 0.323 | −0.175 | 4.915 |
| 0.310 | −0.177 | 4.915 |
| 0.297 | −0.179 | 4.915 |
| 0.283 | −0.180 | 4.915 |
| 0.270 | −0.181 | 4.915 |
| 0.257 | −0.181 | 4.915 |
| 0.243 | −0.181 | 4.915 |
| 0.230 | −0.181 | 4.915 |
| 0.217 | −0.180 | 4.915 |
| 0.204 | −0.178 | 4.915 |
| 0.190 | −0.176 | 4.915 |
| 0.177 | −0.174 | 4.915 |
| 0.164 | −0.171 | 4.915 |
| 0.151 | −0.168 | 4.915 |
| 0.138 | −0.165 | 4.915 |
| 0.126 | −0.161 | 4.915 |
| 0.113 | −0.156 | 4.915 |
| 0.100 | −0.152 | 4.915 |
| 0.088 | −0.147 | 4.915 |
| 0.076 | −0.141 | 4.915 |
| 0.064 | −0.136 | 4.915 |
| 0.052 | −0.130 | 4.915 |
| 0.040 | −0.123 | 4.915 |
| 0.028 | −0.117 | 4.915 |
| 0.017 | −0.110 | 4.915 |
| 0.006 | −0.103 | 4.915 |
| −0.006 | −0.096 | 4.915 |
| −0.017 | −0.088 | 4.915 |
| −0.027 | −0.080 | 4.915 |
| −0.038 | −0.073 | 4.915 |
| −0.049 | −0.064 | 4.915 |
| −0.059 | −0.056 | 4.915 |
| −0.069 | −0.047 | 4.915 |
| −0.079 | −0.039 | 4.915 |
| −0.089 | −0.030 | 4.915 |

TABLE 2-continued

| X | Y | Z |
|---|---|---|
| −0.099 | −0.021 | 4.915 |
| −0.109 | −0.012 | 4.915 |
| −0.118 | −0.002 | 4.915 |
| −0.128 | 0.007 | 4.915 |
| −0.137 | 0.017 | 4.915 |
| −0.146 | 0.026 | 4.915 |
| −0.155 | 0.036 | 4.915 |
| −0.164 | 0.046 | 4.915 |
| −0.173 | 0.056 | 4.915 |
| −0.182 | 0.066 | 4.915 |
| −0.191 | 0.076 | 4.915 |
| −0.199 | 0.086 | 4.915 |
| −0.208 | 0.097 | 4.915 |
| −0.216 | 0.107 | 4.915 |
| −0.224 | 0.117 | 4.915 |
| −0.233 | 0.128 | 4.915 |
| −0.241 | 0.139 | 4.915 |
| −0.249 | 0.149 | 4.915 |
| −0.256 | 0.160 | 4.915 |
| −0.264 | 0.171 | 4.915 |
| −0.272 | 0.182 | 4.915 |
| −0.279 | 0.193 | 4.915 |
| −0.287 | 0.204 | 4.915 |
| −0.294 | 0.215 | 4.915 |
| −0.302 | 0.226 | 4.915 |
| −0.309 | 0.237 | 4.915 |
| −0.316 | 0.248 | 4.915 |
| −0.323 | 0.260 | 4.915 |
| −0.331 | 0.271 | 4.915 |
| −0.338 | 0.282 | 4.915 |
| −0.345 | 0.294 | 4.915 |
| −0.352 | 0.305 | 4.915 |
| −0.359 | 0.316 | 4.915 |
| −0.365 | 0.328 | 4.915 |
| −0.372 | 0.339 | 4.915 |
| −0.379 | 0.351 | 4.915 |
| −0.386 | 0.362 | 4.915 |
| −0.393 | 0.374 | 4.915 |
| −0.394 | 0.376 | 4.915 |
| −0.395 | 0.378 | 4.915 |
| −0.397 | 0.381 | 4.915 |
| −0.398 | 0.383 | 4.915 |
| −0.399 | 0.385 | 4.915 |
| −0.401 | 0.388 | 4.915 |
| −0.402 | 0.390 | 4.915 |
| −0.404 | 0.392 | 4.915 |
| −0.405 | 0.394 | 4.915 |
| −0.406 | 0.397 | 4.915 |
| −0.407 | 0.399 | 4.915 |
| −0.408 | 0.400 | 4.915 |
| −0.408 | 0.402 | 4.915 |
| −0.408 | 0.404 | 4.915 |
| −0.408 | 0.406 | 4.915 |
| −0.407 | 0.408 | 4.915 |
| −0.406 | 0.410 | 4.915 |
| −0.405 | 0.412 | 4.915 |
| −0.403 | 0.413 | 4.915 |
| −0.402 | 0.414 | 4.915 |
| −0.400 | 0.415 | 4.915 |
| −0.398 | 0.415 | 4.915 |
| −0.396 | 0.416 | 4.915 |
| −0.394 | 0.415 | 4.915 |
| −0.392 | 0.415 | 4.915 |
| −0.390 | 0.414 | 4.915 |
| −0.388 | 0.413 | 4.915 |
| −0.387 | 0.412 | 4.915 |
| −0.385 | 0.411 | 4.915 |
| −0.384 | 0.409 | 4.915 |
| −0.383 | 0.407 | 4.915 |
| −0.381 | 0.405 | 4.915 |
| −0.380 | 0.403 | 4.915 |
| −0.378 | 0.401 | 4.915 |
| −0.377 | 0.399 | 4.915 |
| −0.375 | 0.397 | 4.915 |
| −0.374 | 0.395 | 4.915 |
| −0.373 | 0.393 | 4.915 |
| −0.371 | 0.391 | 4.915 |
| −0.364 | 0.382 | 4.915 |

TABLE 2-continued

| X | Y | Z |
|---|---|---|
| −0.357 | 0.372 | 4.915 |
| −0.349 | 0.363 | 4.915 |
| −0.342 | 0.353 | 4.915 |
| −0.335 | 0.343 | 4.915 |
| −0.328 | 0.334 | 4.915 |
| −0.320 | 0.324 | 4.915 |
| −0.313 | 0.315 | 4.915 |
| −0.305 | 0.306 | 4.915 |
| −0.298 | 0.296 | 4.915 |
| −0.290 | 0.287 | 4.915 |
| −0.283 | 0.278 | 4.915 |
| −0.275 | 0.268 | 4.915 |
| −0.267 | 0.259 | 4.915 |
| −0.259 | 0.250 | 4.915 |
| −0.252 | 0.241 | 4.915 |
| −0.244 | 0.232 | 4.915 |
| −0.236 | 0.223 | 4.915 |
| −0.228 | 0.214 | 4.915 |
| −0.220 | 0.205 | 4.915 |
| −0.211 | 0.196 | 4.915 |
| −0.203 | 0.188 | 4.915 |
| −0.195 | 0.179 | 4.915 |
| −0.186 | 0.171 | 4.915 |
| −0.178 | 0.162 | 4.915 |
| −0.169 | 0.154 | 4.915 |
| −0.161 | 0.145 | 4.915 |
| −0.152 | 0.137 | 4.915 |
| −0.143 | 0.129 | 4.915 |
| −0.134 | 0.121 | 4.915 |
| −0.125 | 0.113 | 4.915 |
| −0.116 | 0.105 | 4.915 |
| −0.107 | 0.097 | 4.915 |
| −0.098 | 0.090 | 4.915 |
| −0.089 | 0.082 | 4.915 |
| −0.079 | 0.075 | 4.915 |
| −0.070 | 0.067 | 4.915 |
| −0.060 | 0.060 | 4.915 |
| −0.050 | 0.053 | 4.915 |
| −0.041 | 0.046 | 4.915 |
| −0.031 | 0.039 | 4.915 |
| −0.021 | 0.032 | 4.915 |
| −0.011 | 0.026 | 4.915 |
| −0.001 | 0.019 | 4.915 |
| 0.009 | 0.013 | 4.915 |
| 0.020 | 0.006 | 4.915 |
| 0.030 | 0.000 | 4.915 |
| 0.040 | −0.006 | 4.915 |
| 0.051 | −0.011 | 4.915 |
| 0.061 | −0.017 | 4.915 |
| 0.072 | −0.022 | 4.915 |
| 0.083 | −0.028 | 4.915 |
| 0.094 | −0.033 | 4.915 |
| 0.105 | −0.038 | 4.915 |
| 0.116 | −0.043 | 4.915 |
| 0.127 | −0.047 | 4.915 |
| 0.138 | −0.052 | 4.915 |
| 0.149 | −0.056 | 4.915 |
| 0.161 | −0.060 | 4.915 |
| 0.172 | −0.064 | 4.915 |
| 0.183 | −0.067 | 4.915 |
| 0.195 | −0.071 | 4.915 |
| 0.206 | −0.074 | 4.915 |
| 0.218 | −0.077 | 4.915 |
| 0.230 | −0.079 | 4.915 |
| 0.242 | −0.082 | 4.915 |
| 0.253 | −0.084 | 4.915 |
| 0.265 | −0.086 | 4.915 |
| 0.277 | −0.088 | 4.915 |
| 0.289 | −0.090 | 4.915 |
| 0.301 | −0.091 | 4.915 |
| 0.313 | −0.092 | 4.915 |
| 0.325 | −0.093 | 4.915 |
| 0.337 | −0.093 | 4.915 |
| 0.349 | −0.094 | 4.915 |
| 0.361 | −0.094 | 4.915 |
| 0.373 | −0.094 | 4.915 |
| 0.385 | −0.094 | 4.915 |
| 0.397 | −0.093 | 4.915 |

TABLE 2-continued

| | X | Y | Z |
|---|---|---|---|
| | 0.399 | −0.093 | 4.915 |
| | 0.402 | −0.093 | 4.915 |
| | 0.404 | −0.093 | 4.915 |
| | 0.406 | −0.092 | 4.915 |
| | 0.409 | −0.092 | 4.915 |
| | 0.411 | −0.092 | 4.915 |
| | 0.414 | −0.092 | 4.915 |
| | 0.416 | −0.092 | 4.915 |
| | 0.418 | −0.091 | 4.915 |
| | 0.421 | −0.091 | 4.915 |
| | 0.424 | −0.091 | 4.915 |
| | 0.428 | −0.091 | 4.915 |
| | 0.431 | −0.091 | 4.915 |
| | 0.435 | −0.092 | 4.915 |
| | 0.438 | −0.093 | 4.915 |
| | 0.441 | −0.095 | 4.915 |
| | 0.444 | −0.097 | 4.915 |
| | 0.447 | −0.100 | 4.915 |
| | 0.448 | −0.102 | 4.915 |
| | 0.450 | −0.106 | 4.915 |
| | 0.450 | −0.109 | 4.915 |
| | 0.450 | −0.113 | 4.915 |
| | 0.448 | −0.116 | 4.915 |
| | 0.447 | −0.119 | 4.915 |
| | 0.445 | −0.122 | 4.915 |
| | 0.443 | −0.125 | 4.915 |
| | 0.440 | −0.127 | 4.915 |
| | 0.437 | −0.130 | 4.915 |
| SECTION 8 | | | |
| | 0.448 | −0.141 | 5.185 |
| | 0.446 | −0.143 | 5.185 |
| | 0.443 | −0.144 | 5.185 |
| | 0.441 | −0.146 | 5.185 |
| | 0.438 | −0.147 | 5.185 |
| | 0.436 | −0.149 | 5.185 |
| | 0.434 | −0.150 | 5.185 |
| | 0.431 | −0.151 | 5.185 |
| | 0.429 | −0.153 | 5.185 |
| | 0.426 | −0.154 | 5.185 |
| | 0.424 | −0.155 | 5.185 |
| | 0.411 | −0.162 | 5.185 |
| | 0.398 | −0.167 | 5.185 |
| | 0.385 | −0.172 | 5.185 |
| | 0.371 | −0.177 | 5.185 |
| | 0.358 | −0.181 | 5.185 |
| | 0.344 | −0.185 | 5.185 |
| | 0.330 | −0.188 | 5.185 |
| | 0.316 | −0.190 | 5.185 |
| | 0.302 | −0.192 | 5.185 |
| | 0.288 | −0.194 | 5.185 |
| | 0.274 | −0.195 | 5.185 |
| | 0.260 | −0.195 | 5.185 |
| | 0.246 | −0.195 | 5.185 |
| | 0.232 | −0.194 | 5.185 |
| | 0.218 | −0.193 | 5.185 |
| | 0.204 | −0.192 | 5.185 |
| | 0.190 | −0.190 | 5.185 |
| | 0.176 | −0.187 | 5.185 |
| | 0.162 | −0.184 | 5.185 |
| | 0.148 | −0.181 | 5.185 |
| | 0.135 | −0.177 | 5.185 |
| | 0.121 | −0.173 | 5.185 |
| | 0.108 | −0.168 | 5.185 |
| | 0.094 | −0.163 | 5.185 |
| | 0.081 | −0.158 | 5.185 |
| | 0.068 | −0.152 | 5.185 |
| | 0.056 | −0.146 | 5.185 |
| | 0.043 | −0.139 | 5.185 |
| | 0.031 | −0.133 | 5.185 |
| | 0.018 | −0.126 | 5.185 |
| | 0.006 | −0.118 | 5.185 |
| | −0.006 | −0.111 | 5.185 |
| | −0.017 | −0.103 | 5.185 |
| | −0.029 | −0.095 | 5.185 |
| | −0.040 | −0.086 | 5.185 |
| | −0.052 | −0.078 | 5.185 |
| | −0.063 | −0.069 | 5.185 |

TABLE 2-continued

| X | Y | Z |
|---|---|---|
| −0.074 | −0.060 | 5.185 |
| −0.084 | −0.051 | 5.185 |
| −0.095 | −0.041 | 5.185 |
| −0.105 | −0.032 | 5.185 |
| −0.116 | −0.022 | 5.185 |
| −0.126 | −0.012 | 5.185 |
| −0.136 | −0.002 | 5.185 |
| −0.146 | 0.008 | 5.185 |
| −0.155 | 0.018 | 5.185 |
| −0.165 | 0.029 | 5.185 |
| −0.174 | 0.039 | 5.185 |
| −0.184 | 0.050 | 5.185 |
| −0.193 | 0.060 | 5.185 |
| −0.202 | 0.071 | 5.185 |
| −0.211 | 0.082 | 5.185 |
| −0.220 | 0.093 | 5.185 |
| −0.229 | 0.104 | 5.185 |
| −0.237 | 0.116 | 5.185 |
| −0.246 | 0.127 | 5.185 |
| −0.254 | 0.138 | 5.185 |
| −0.262 | 0.150 | 5.185 |
| −0.270 | 0.161 | 5.185 |
| −0.279 | 0.173 | 5.185 |
| −0.286 | 0.185 | 5.185 |
| −0.294 | 0.197 | 5.185 |
| −0.302 | 0.208 | 5.185 |
| −0.310 | 0.220 | 5.185 |
| −0.317 | 0.232 | 5.185 |
| −0.325 | 0.244 | 5.185 |
| −0.332 | 0.256 | 5.185 |
| −0.339 | 0.268 | 5.185 |
| −0.347 | 0.280 | 5.185 |
| −0.354 | 0.293 | 5.185 |
| −0.361 | 0.305 | 5.185 |
| −0.368 | 0.317 | 5.185 |
| −0.375 | 0.329 | 5.185 |
| −0.382 | 0.342 | 5.185 |
| −0.389 | 0.354 | 5.185 |
| −0.396 | 0.366 | 5.185 |
| −0.403 | 0.379 | 5.185 |
| −0.410 | 0.391 | 5.185 |
| −0.417 | 0.403 | 5.185 |
| −0.418 | 0.406 | 5.185 |
| −0.420 | 0.408 | 5.185 |
| −0.421 | 0.411 | 5.185 |
| −0.422 | 0.413 | 5.185 |
| −0.424 | 0.416 | 5.185 |
| −0.425 | 0.418 | 5.185 |
| −0.426 | 0.421 | 5.185 |
| −0.428 | 0.423 | 5.185 |
| −0.429 | 0.426 | 5.185 |
| −0.430 | 0.428 | 5.185 |
| −0.431 | 0.430 | 5.185 |
| −0.432 | 0.432 | 5.185 |
| −0.432 | 0.434 | 5.185 |
| −0.432 | 0.436 | 5.185 |
| −0.432 | 0.438 | 5.185 |
| −0.431 | 0.440 | 5.185 |
| −0.430 | 0.441 | 5.185 |
| −0.429 | 0.443 | 5.185 |
| −0.427 | 0.444 | 5.185 |
| −0.425 | 0.445 | 5.185 |
| −0.424 | 0.446 | 5.185 |
| −0.422 | 0.447 | 5.185 |
| −0.420 | 0.447 | 5.185 |
| −0.418 | 0.447 | 5.185 |
| −0.416 | 0.446 | 5.185 |
| −0.414 | 0.445 | 5.185 |
| −0.412 | 0.444 | 5.185 |
| −0.411 | 0.443 | 5.185 |
| −0.409 | 0.441 | 5.185 |
| −0.408 | 0.439 | 5.185 |
| −0.406 | 0.437 | 5.185 |
| −0.405 | 0.435 | 5.185 |
| −0.404 | 0.433 | 5.185 |
| −0.402 | 0.431 | 5.185 |
| −0.401 | 0.429 | 5.185 |
| −0.399 | 0.427 | 5.185 |

TABLE 2-continued

| X | Y | Z |
|---|---|---|
| −0.398 | 0.425 | 5.185 |
| −0.396 | 0.423 | 5.185 |
| −0.395 | 0.421 | 5.185 |
| −0.387 | 0.410 | 5.185 |
| −0.380 | 0.400 | 5.185 |
| −0.372 | 0.390 | 5.185 |
| −0.365 | 0.379 | 5.185 |
| −0.358 | 0.369 | 5.185 |
| −0.350 | 0.359 | 5.185 |
| −0.342 | 0.349 | 5.185 |
| −0.335 | 0.339 | 5.185 |
| −0.327 | 0.328 | 5.185 |
| −0.319 | 0.318 | 5.185 |
| −0.311 | 0.308 | 5.185 |
| −0.304 | 0.298 | 5.185 |
| −0.296 | 0.288 | 5.185 |
| −0.288 | 0.279 | 5.185 |
| −0.280 | 0.269 | 5.185 |
| −0.271 | 0.259 | 5.185 |
| −0.263 | 0.249 | 5.185 |
| −0.255 | 0.240 | 5.185 |
| −0.247 | 0.230 | 5.185 |
| −0.238 | 0.221 | 5.185 |
| −0.230 | 0.211 | 5.185 |
| −0.221 | 0.202 | 5.185 |
| −0.212 | 0.193 | 5.185 |
| −0.204 | 0.183 | 5.185 |
| −0.195 | 0.174 | 5.185 |
| −0.186 | 0.165 | 5.185 |
| −0.177 | 0.156 | 5.185 |
| −0.168 | 0.147 | 5.185 |
| −0.158 | 0.139 | 5.185 |
| −0.149 | 0.130 | 5.185 |
| −0.140 | 0.121 | 5.185 |
| −0.130 | 0.113 | 5.185 |
| −0.121 | 0.105 | 5.185 |
| −0.111 | 0.096 | 5.185 |
| −0.101 | 0.088 | 5.185 |
| −0.092 | 0.080 | 5.185 |
| −0.082 | 0.072 | 5.185 |
| −0.072 | 0.064 | 5.185 |
| −0.062 | 0.057 | 5.185 |
| −0.051 | 0.049 | 5.185 |
| −0.041 | 0.042 | 5.185 |
| −0.031 | 0.034 | 5.185 |
| −0.020 | 0.027 | 5.185 |
| −0.010 | 0.020 | 5.185 |
| 0.001 | 0.013 | 5.185 |
| 0.012 | 0.006 | 5.185 |
| 0.023 | 0.000 | 5.185 |
| 0.034 | −0.007 | 5.185 |
| 0.045 | −0.013 | 5.185 |
| 0.056 | −0.019 | 5.185 |
| 0.067 | −0.025 | 5.185 |
| 0.078 | −0.031 | 5.185 |
| 0.090 | −0.037 | 5.185 |
| 0.101 | −0.042 | 5.185 |
| 0.113 | −0.047 | 5.185 |
| 0.124 | −0.052 | 5.185 |
| 0.136 | −0.057 | 5.185 |
| 0.148 | −0.062 | 5.185 |
| 0.160 | −0.066 | 5.185 |
| 0.172 | −0.070 | 5.185 |
| 0.184 | −0.074 | 5.185 |
| 0.196 | −0.078 | 5.185 |
| 0.208 | −0.082 | 5.185 |
| 0.220 | −0.085 | 5.185 |
| 0.233 | −0.088 | 5.185 |
| 0.245 | −0.091 | 5.185 |
| 0.258 | −0.093 | 5.185 |
| 0.270 | −0.096 | 5.185 |
| 0.283 | −0.098 | 5.185 |
| 0.295 | −0.099 | 5.185 |
| 0.308 | −0.101 | 5.185 |
| 0.321 | −0.102 | 5.185 |
| 0.333 | −0.103 | 5.185 |
| 0.346 | −0.104 | 5.185 |
| 0.359 | −0.104 | 5.185 |

TABLE 2-continued

| X | Y | Z |
|---|---|---|
| 0.371 | −0.104 | 5.185 |
| 0.384 | −0.104 | 5.185 |
| 0.397 | −0.104 | 5.185 |
| 0.409 | −0.103 | 5.185 |
| 0.412 | −0.103 | 5.185 |
| 0.414 | −0.103 | 5.185 |
| 0.417 | −0.103 | 5.185 |
| 0.420 | −0.102 | 5.185 |
| 0.422 | −0.102 | 5.185 |
| 0.425 | −0.102 | 5.185 |
| 0.427 | −0.102 | 5.185 |
| 0.430 | −0.102 | 5.185 |
| 0.432 | −0.101 | 5.185 |
| 0.435 | −0.101 | 5.185 |
| 0.438 | −0.101 | 5.185 |
| 0.442 | −0.101 | 5.185 |
| 0.445 | −0.101 | 5.185 |
| 0.449 | −0.102 | 5.185 |
| 0.452 | −0.103 | 5.185 |
| 0.455 | −0.105 | 5.185 |
| 0.458 | −0.107 | 5.185 |
| 0.460 | −0.109 | 5.185 |
| 0.462 | −0.112 | 5.185 |
| 0.463 | −0.116 | 5.185 |
| 0.464 | −0.119 | 5.185 |
| 0.463 | −0.123 | 5.185 |
| 0.462 | −0.126 | 5.185 |
| 0.461 | −0.129 | 5.185 |
| 0.459 | −0.132 | 5.185 |
| 0.456 | −0.135 | 5.185 |
| 0.454 | −0.137 | 5.185 |
| 0.451 | −0.139 | 5.185 |
| SECTION 9 | | |
| 0.463 | −0.151 | 5.455 |
| 0.461 | −0.153 | 5.455 |
| 0.458 | −0.154 | 5.455 |
| 0.456 | −0.156 | 5.455 |
| 0.453 | −0.157 | 5.455 |
| 0.451 | −0.159 | 5.455 |
| 0.448 | −0.160 | 5.455 |
| 0.445 | −0.162 | 5.455 |
| 0.443 | −0.163 | 5.455 |
| 0.440 | −0.164 | 5.455 |
| 0.437 | −0.166 | 5.455 |
| 0.424 | −0.172 | 5.455 |
| 0.410 | −0.178 | 5.455 |
| 0.396 | −0.184 | 5.455 |
| 0.382 | −0.189 | 5.455 |
| 0.368 | −0.193 | 5.455 |
| 0.353 | −0.197 | 5.455 |
| 0.339 | −0.200 | 5.455 |
| 0.324 | −0.203 | 5.455 |
| 0.309 | −0.205 | 5.455 |
| 0.294 | −0.206 | 5.455 |
| 0.279 | −0.207 | 5.455 |
| 0.264 | −0.208 | 5.455 |
| 0.250 | −0.208 | 5.455 |
| 0.235 | −0.207 | 5.455 |
| 0.220 | −0.206 | 5.455 |
| 0.205 | −0.204 | 5.455 |
| 0.190 | −0.202 | 5.455 |
| 0.175 | −0.199 | 5.455 |
| 0.161 | −0.196 | 5.455 |
| 0.146 | −0.192 | 5.455 |
| 0.132 | −0.188 | 5.455 |
| 0.117 | −0.184 | 5.455 |
| 0.103 | −0.179 | 5.455 |
| 0.089 | −0.174 | 5.455 |
| 0.076 | −0.168 | 5.455 |
| 0.062 | −0.162 | 5.455 |
| 0.048 | −0.155 | 5.455 |
| 0.035 | −0.148 | 5.455 |
| 0.022 | −0.141 | 5.455 |
| 0.009 | −0.134 | 5.455 |
| −0.004 | −0.126 | 5.455 |
| −0.016 | −0.118 | 5.455 |
| −0.029 | −0.109 | 5.455 |

TABLE 2-continued

| X | Y | Z |
|---|---|---|
| −0.041 | −0.101 | 5.455 |
| −0.053 | −0.092 | 5.455 |
| −0.065 | −0.083 | 5.455 |
| −0.076 | −0.073 | 5.455 |
| −0.088 | −0.064 | 5.455 |
| −0.099 | −0.054 | 5.455 |
| −0.110 | −0.044 | 5.455 |
| −0.121 | −0.034 | 5.455 |
| −0.132 | −0.023 | 5.455 |
| −0.143 | −0.013 | 5.455 |
| −0.153 | −0.002 | 5.455 |
| −0.163 | 0.009 | 5.455 |
| −0.174 | 0.020 | 5.455 |
| −0.184 | 0.031 | 5.455 |
| −0.193 | 0.042 | 5.455 |
| −0.203 | 0.054 | 5.455 |
| −0.213 | 0.065 | 5.455 |
| −0.222 | 0.077 | 5.455 |
| −0.231 | 0.088 | 5.455 |
| −0.241 | 0.100 | 5.455 |
| −0.250 | 0.112 | 5.455 |
| −0.259 | 0.124 | 5.455 |
| −0.267 | 0.136 | 5.455 |
| −0.276 | 0.149 | 5.455 |
| −0.284 | 0.161 | 5.455 |
| −0.293 | 0.173 | 5.455 |
| −0.301 | 0.186 | 5.455 |
| −0.309 | 0.198 | 5.455 |
| −0.317 | 0.211 | 5.455 |
| −0.325 | 0.224 | 5.455 |
| −0.333 | 0.236 | 5.455 |
| −0.341 | 0.249 | 5.455 |
| −0.348 | 0.262 | 5.455 |
| −0.356 | 0.275 | 5.455 |
| −0.363 | 0.288 | 5.455 |
| −0.370 | 0.301 | 5.455 |
| −0.378 | 0.314 | 5.455 |
| −0.385 | 0.327 | 5.455 |
| −0.392 | 0.340 | 5.455 |
| −0.399 | 0.354 | 5.455 |
| −0.407 | 0.367 | 5.455 |
| −0.414 | 0.380 | 5.455 |
| −0.421 | 0.393 | 5.455 |
| −0.428 | 0.406 | 5.455 |
| −0.435 | 0.420 | 5.455 |
| −0.442 | 0.433 | 5.455 |
| −0.443 | 0.435 | 5.455 |
| −0.444 | 0.438 | 5.455 |
| −0.446 | 0.441 | 5.455 |
| −0.447 | 0.443 | 5.455 |
| −0.449 | 0.446 | 5.455 |
| −0.450 | 0.449 | 5.455 |
| −0.451 | 0.451 | 5.455 |
| −0.453 | 0.454 | 5.455 |
| −0.454 | 0.457 | 5.455 |
| −0.455 | 0.459 | 5.455 |
| −0.456 | 0.461 | 5.455 |
| −0.457 | 0.463 | 5.455 |
| −0.457 | 0.465 | 5.455 |
| −0.457 | 0.467 | 5.455 |
| −0.456 | 0.469 | 5.455 |
| −0.456 | 0.471 | 5.455 |
| −0.455 | 0.473 | 5.455 |
| −0.453 | 0.474 | 5.455 |
| −0.452 | 0.475 | 5.455 |
| −0.450 | 0.476 | 5.455 |
| −0.448 | 0.477 | 5.455 |
| −0.446 | 0.478 | 5.455 |
| −0.444 | 0.478 | 5.455 |
| −0.442 | 0.477 | 5.455 |
| −0.440 | 0.477 | 5.455 |
| −0.439 | 0.476 | 5.455 |
| −0.437 | 0.475 | 5.455 |
| −0.435 | 0.474 | 5.455 |
| −0.434 | 0.472 | 5.455 |
| −0.433 | 0.470 | 5.455 |
| −0.431 | 0.468 | 5.455 |
| −0.430 | 0.465 | 5.455 |

TABLE 2-continued

| X | Y | Z |
|---|---|---|
| −0.428 | 0.463 | 5.455 |
| −0.427 | 0.461 | 5.455 |
| −0.425 | 0.459 | 5.455 |
| −0.424 | 0.457 | 5.455 |
| −0.422 | 0.454 | 5.455 |
| −0.421 | 0.452 | 5.455 |
| −0.419 | 0.450 | 5.455 |
| −0.411 | 0.439 | 5.455 |
| −0.404 | 0.428 | 5.455 |
| −0.396 | 0.417 | 5.455 |
| −0.388 | 0.406 | 5.455 |
| −0.381 | 0.395 | 5.455 |
| −0.373 | 0.384 | 5.455 |
| −0.365 | 0.373 | 5.455 |
| −0.357 | 0.362 | 5.455 |
| −0.349 | 0.351 | 5.455 |
| −0.341 | 0.340 | 5.455 |
| −0.333 | 0.330 | 5.455 |
| −0.325 | 0.319 | 5.455 |
| −0.317 | 0.308 | 5.455 |
| −0.308 | 0.298 | 5.455 |
| −0.300 | 0.287 | 5.455 |
| −0.292 | 0.277 | 5.455 |
| −0.283 | 0.266 | 5.455 |
| −0.274 | 0.256 | 5.455 |
| −0.266 | 0.246 | 5.455 |
| −0.257 | 0.236 | 5.455 |
| −0.248 | 0.226 | 5.455 |
| −0.239 | 0.216 | 5.455 |
| −0.230 | 0.206 | 5.455 |
| −0.221 | 0.196 | 5.455 |
| −0.212 | 0.186 | 5.455 |
| −0.202 | 0.176 | 5.455 |
| −0.193 | 0.167 | 5.455 |
| −0.183 | 0.157 | 5.455 |
| −0.174 | 0.148 | 5.455 |
| −0.164 | 0.139 | 5.455 |
| −0.154 | 0.130 | 5.455 |
| −0.144 | 0.120 | 5.455 |
| −0.134 | 0.111 | 5.455 |
| −0.124 | 0.103 | 5.455 |
| −0.114 | 0.094 | 5.455 |
| −0.104 | 0.085 | 5.455 |
| −0.093 | 0.077 | 5.455 |
| −0.083 | 0.068 | 5.455 |
| −0.072 | 0.060 | 5.455 |
| −0.061 | 0.052 | 5.455 |
| −0.051 | 0.044 | 5.455 |
| −0.040 | 0.036 | 5.455 |
| −0.029 | 0.028 | 5.455 |
| −0.018 | 0.021 | 5.455 |
| −0.006 | 0.013 | 5.455 |
| 0.005 | 0.006 | 5.455 |
| 0.016 | −0.001 | 5.455 |
| 0.028 | −0.008 | 5.455 |
| 0.039 | −0.015 | 5.455 |
| 0.051 | −0.021 | 5.455 |
| 0.063 | −0.028 | 5.455 |
| 0.075 | −0.034 | 5.455 |
| 0.087 | −0.040 | 5.455 |
| 0.099 | −0.046 | 5.455 |
| 0.111 | −0.051 | 5.455 |
| 0.123 | −0.057 | 5.455 |
| 0.136 | −0.062 | 5.455 |
| 0.148 | −0.067 | 5.455 |
| 0.161 | −0.072 | 5.455 |
| 0.173 | −0.076 | 5.455 |
| 0.186 | −0.081 | 5.455 |
| 0.199 | −0.085 | 5.455 |
| 0.212 | −0.089 | 5.455 |
| 0.225 | −0.092 | 5.455 |
| 0.238 | −0.096 | 5.455 |
| 0.251 | −0.099 | 5.455 |
| 0.264 | −0.101 | 5.455 |
| 0.277 | −0.104 | 5.455 |
| 0.290 | −0.106 | 5.455 |
| 0.304 | −0.108 | 5.455 |
| 0.317 | −0.110 | 5.455 |

TABLE 2-continued

| X | Y | Z |
|---|---|---|
| 0.330 | −0.111 | 5.455 |
| 0.344 | −0.112 | 5.455 |
| 0.357 | −0.113 | 5.455 |
| 0.371 | −0.113 | 5.455 |
| 0.384 | −0.114 | 5.455 |
| 0.398 | −0.113 | 5.455 |
| 0.411 | −0.113 | 5.455 |
| 0.424 | −0.112 | 5.455 |
| 0.427 | −0.112 | 5.455 |
| 0.430 | −0.112 | 5.455 |
| 0.432 | −0.112 | 5.455 |
| 0.435 | −0.112 | 5.455 |
| 0.438 | −0.111 | 5.455 |
| 0.440 | −0.111 | 5.455 |
| 0.443 | −0.111 | 5.455 |
| 0.446 | −0.111 | 5.455 |
| 0.449 | −0.110 | 5.455 |
| 0.451 | −0.110 | 5.455 |
| 0.455 | −0.110 | 5.455 |
| 0.458 | −0.110 | 5.455 |
| 0.462 | −0.110 | 5.455 |
| 0.465 | −0.111 | 5.455 |
| 0.469 | −0.112 | 5.455 |
| 0.472 | −0.114 | 5.455 |
| 0.474 | −0.116 | 5.455 |
| 0.477 | −0.119 | 5.455 |
| 0.478 | −0.122 | 5.455 |
| 0.479 | −0.125 | 5.455 |
| 0.479 | −0.129 | 5.455 |
| 0.479 | −0.132 | 5.455 |
| 0.478 | −0.136 | 5.455 |
| 0.476 | −0.139 | 5.455 |
| 0.474 | −0.142 | 5.455 |
| 0.472 | −0.144 | 5.455 |
| 0.469 | −0.147 | 5.455 |
| 0.466 | −0.149 | 5.455 |
| SECTION 10 | | |
| 0.480 | −0.161 | 5.725 |
| 0.477 | −0.162 | 5.725 |
| 0.474 | −0.164 | 5.725 |
| 0.472 | −0.166 | 5.725 |
| 0.469 | −0.167 | 5.725 |
| 0.466 | −0.169 | 5.725 |
| 0.463 | −0.170 | 5.725 |
| 0.460 | −0.172 | 5.725 |
| 0.458 | −0.173 | 5.725 |
| 0.455 | −0.175 | 5.725 |
| 0.452 | −0.176 | 5.725 |
| 0.438 | −0.183 | 5.725 |
| 0.423 | −0.189 | 5.725 |
| 0.409 | −0.195 | 5.725 |
| 0.394 | −0.200 | 5.725 |
| 0.378 | −0.204 | 5.725 |
| 0.363 | −0.208 | 5.725 |
| 0.348 | −0.211 | 5.725 |
| 0.332 | −0.214 | 5.725 |
| 0.317 | −0.216 | 5.725 |
| 0.301 | −0.218 | 5.725 |
| 0.285 | −0.219 | 5.725 |
| 0.269 | −0.219 | 5.725 |
| 0.254 | −0.219 | 5.725 |
| 0.238 | −0.218 | 5.725 |
| 0.222 | −0.217 | 5.725 |
| 0.206 | −0.216 | 5.725 |
| 0.191 | −0.213 | 5.725 |
| 0.175 | −0.211 | 5.725 |
| 0.160 | −0.207 | 5.725 |
| 0.144 | −0.204 | 5.725 |
| 0.129 | −0.199 | 5.725 |
| 0.114 | −0.195 | 5.725 |
| 0.099 | −0.189 | 5.725 |
| 0.085 | −0.184 | 5.725 |
| 0.070 | −0.178 | 5.725 |
| 0.056 | −0.171 | 5.725 |
| 0.041 | −0.165 | 5.725 |
| 0.027 | −0.157 | 5.725 |
| 0.013 | −0.150 | 5.725 |

TABLE 2-continued

| X | Y | Z |
|---|---|---|
| 0.000 | −0.142 | 5.725 |
| −0.014 | −0.134 | 5.725 |
| −0.027 | −0.125 | 5.725 |
| −0.040 | −0.116 | 5.725 |
| −0.053 | −0.107 | 5.725 |
| −0.065 | −0.097 | 5.725 |
| −0.078 | −0.088 | 5.725 |
| −0.090 | −0.078 | 5.725 |
| −0.102 | −0.068 | 5.725 |
| −0.114 | −0.057 | 5.725 |
| −0.126 | −0.046 | 5.725 |
| −0.137 | −0.036 | 5.725 |
| −0.148 | −0.025 | 5.725 |
| −0.159 | −0.013 | 5.725 |
| −0.170 | −0.002 | 5.725 |
| −0.181 | 0.010 | 5.725 |
| −0.192 | 0.021 | 5.725 |
| −0.202 | 0.033 | 5.725 |
| −0.212 | 0.045 | 5.725 |
| −0.222 | 0.057 | 5.725 |
| −0.232 | 0.070 | 5.725 |
| −0.242 | 0.082 | 5.725 |
| −0.252 | 0.094 | 5.725 |
| −0.261 | 0.107 | 5.725 |
| −0.270 | 0.120 | 5.725 |
| −0.280 | 0.133 | 5.725 |
| −0.289 | 0.146 | 5.725 |
| −0.298 | 0.159 | 5.725 |
| −0.306 | 0.172 | 5.725 |
| −0.315 | 0.185 | 5.725 |
| −0.323 | 0.198 | 5.725 |
| −0.332 | 0.212 | 5.725 |
| −0.340 | 0.225 | 5.725 |
| −0.348 | 0.239 | 5.725 |
| −0.356 | 0.253 | 5.725 |
| −0.364 | 0.266 | 5.725 |
| −0.371 | 0.280 | 5.725 |
| −0.379 | 0.294 | 5.725 |
| −0.387 | 0.308 | 5.725 |
| −0.394 | 0.322 | 5.725 |
| −0.401 | 0.335 | 5.725 |
| −0.409 | 0.349 | 5.725 |
| −0.416 | 0.363 | 5.725 |
| −0.423 | 0.377 | 5.725 |
| −0.431 | 0.391 | 5.725 |
| −0.438 | 0.406 | 5.725 |
| −0.445 | 0.420 | 5.725 |
| −0.452 | 0.434 | 5.725 |
| −0.459 | 0.448 | 5.725 |
| −0.466 | 0.462 | 5.725 |
| −0.468 | 0.465 | 5.725 |
| −0.469 | 0.468 | 5.725 |
| −0.470 | 0.470 | 5.725 |
| −0.472 | 0.473 | 5.725 |
| −0.473 | 0.476 | 5.725 |
| −0.475 | 0.479 | 5.725 |
| −0.476 | 0.482 | 5.725 |
| −0.477 | 0.484 | 5.725 |
| −0.479 | 0.487 | 5.725 |
| −0.480 | 0.490 | 5.725 |
| −0.481 | 0.492 | 5.725 |
| −0.481 | 0.494 | 5.725 |
| −0.482 | 0.496 | 5.725 |
| −0.481 | 0.498 | 5.725 |
| −0.481 | 0.500 | 5.725 |
| −0.480 | 0.502 | 5.725 |
| −0.479 | 0.503 | 5.725 |
| −0.478 | 0.505 | 5.725 |
| −0.476 | 0.506 | 5.725 |
| −0.474 | 0.507 | 5.725 |
| −0.473 | 0.508 | 5.725 |
| −0.471 | 0.508 | 5.725 |
| −0.469 | 0.508 | 5.725 |
| −0.467 | 0.508 | 5.725 |
| −0.465 | 0.507 | 5.725 |
| −0.463 | 0.507 | 5.725 |
| −0.461 | 0.505 | 5.725 |
| −0.460 | 0.504 | 5.725 |

TABLE 2-continued

| X | Y | Z |
|---|---|---|
| −0.459 | 0.502 | 5.725 |
| −0.457 | 0.500 | 5.725 |
| −0.456 | 0.498 | 5.725 |
| −0.454 | 0.495 | 5.725 |
| −0.452 | 0.493 | 5.725 |
| −0.451 | 0.491 | 5.725 |
| −0.449 | 0.488 | 5.725 |
| −0.448 | 0.486 | 5.725 |
| −0.446 | 0.483 | 5.725 |
| −0.445 | 0.481 | 5.725 |
| −0.443 | 0.479 | 5.725 |
| −0.435 | 0.467 | 5.725 |
| −0.428 | 0.455 | 5.725 |
| −0.420 | 0.443 | 5.725 |
| −0.412 | 0.431 | 5.725 |
| −0.404 | 0.420 | 5.725 |
| −0.396 | 0.408 | 5.725 |
| −0.388 | 0.396 | 5.725 |
| −0.380 | 0.385 | 5.725 |
| −0.371 | 0.373 | 5.725 |
| −0.363 | 0.362 | 5.725 |
| −0.355 | 0.350 | 5.725 |
| −0.346 | 0.339 | 5.725 |
| −0.338 | 0.328 | 5.725 |
| −0.329 | 0.316 | 5.725 |
| −0.320 | 0.305 | 5.725 |
| −0.312 | 0.294 | 5.725 |
| −0.303 | 0.283 | 5.725 |
| −0.294 | 0.272 | 5.725 |
| −0.285 | 0.261 | 5.725 |
| −0.275 | 0.251 | 5.725 |
| −0.266 | 0.240 | 5.725 |
| −0.257 | 0.229 | 5.725 |
| −0.247 | 0.219 | 5.725 |
| −0.238 | 0.208 | 5.725 |
| −0.228 | 0.198 | 5.725 |
| −0.218 | 0.188 | 5.725 |
| −0.208 | 0.177 | 5.725 |
| −0.198 | 0.167 | 5.725 |
| −0.188 | 0.157 | 5.725 |
| −0.178 | 0.147 | 5.725 |
| −0.168 | 0.138 | 5.725 |
| −0.158 | 0.128 | 5.725 |
| −0.147 | 0.119 | 5.725 |
| −0.136 | 0.109 | 5.725 |
| −0.126 | 0.100 | 5.725 |
| −0.115 | 0.091 | 5.725 |
| −0.104 | 0.082 | 5.725 |
| −0.093 | 0.073 | 5.725 |
| −0.082 | 0.064 | 5.725 |
| −0.071 | 0.055 | 5.725 |
| −0.059 | 0.047 | 5.725 |
| −0.048 | 0.038 | 5.725 |
| −0.036 | 0.030 | 5.725 |
| −0.025 | 0.022 | 5.725 |
| −0.013 | 0.014 | 5.725 |
| −0.001 | 0.007 | 5.725 |
| 0.011 | −0.001 | 5.725 |
| 0.023 | −0.008 | 5.725 |
| 0.035 | −0.016 | 5.725 |
| 0.048 | −0.023 | 5.725 |
| 0.060 | −0.029 | 5.725 |
| 0.073 | −0.036 | 5.725 |
| 0.085 | −0.042 | 5.725 |
| 0.098 | −0.049 | 5.725 |
| 0.111 | −0.055 | 5.725 |
| 0.124 | −0.060 | 5.725 |
| 0.137 | −0.066 | 5.725 |
| 0.150 | −0.071 | 5.725 |
| 0.163 | −0.076 | 5.725 |
| 0.176 | −0.081 | 5.725 |
| 0.190 | −0.086 | 5.725 |
| 0.203 | −0.090 | 5.725 |
| 0.217 | −0.094 | 5.725 |
| 0.231 | −0.098 | 5.725 |
| 0.244 | −0.102 | 5.725 |
| 0.258 | −0.105 | 5.725 |
| 0.272 | −0.108 | 5.725 |

TABLE 2-continued

| X | Y | Z |
|---|---|---|
| 0.286 | −0.111 | 5.725 |
| 0.300 | −0.113 | 5.725 |
| 0.314 | −0.115 | 5.725 |
| 0.328 | −0.117 | 5.725 |
| 0.342 | −0.119 | 5.725 |
| 0.356 | −0.120 | 5.725 |
| 0.370 | −0.121 | 5.725 |
| 0.384 | −0.122 | 5.725 |
| 0.399 | −0.122 | 5.725 |
| 0.413 | −0.122 | 5.725 |
| 0.427 | −0.122 | 5.725 |
| 0.441 | −0.121 | 5.725 |
| 0.444 | −0.121 | 5.725 |
| 0.447 | −0.121 | 5.725 |
| 0.449 | −0.121 | 5.725 |
| 0.452 | −0.121 | 5.725 |
| 0.455 | −0.120 | 5.725 |
| 0.458 | −0.120 | 5.725 |
| 0.461 | −0.120 | 5.725 |
| 0.464 | −0.120 | 5.725 |
| 0.466 | −0.119 | 5.725 |
| 0.469 | −0.119 | 5.725 |
| 0.473 | −0.119 | 5.725 |
| 0.476 | −0.119 | 5.725 |
| 0.480 | −0.120 | 5.725 |
| 0.483 | −0.121 | 5.725 |
| 0.486 | −0.122 | 5.725 |
| 0.490 | −0.124 | 5.725 |
| 0.492 | −0.126 | 5.725 |
| 0.494 | −0.129 | 5.725 |
| 0.496 | −0.132 | 5.725 |
| 0.496 | −0.136 | 5.725 |
| 0.496 | −0.139 | 5.725 |
| 0.496 | −0.142 | 5.725 |
| 0.494 | −0.146 | 5.725 |
| 0.492 | −0.149 | 5.725 |
| 0.490 | −0.152 | 5.725 |
| 0.488 | −0.154 | 5.725 |
| 0.485 | −0.157 | 5.725 |
| 0.483 | −0.159 | 5.725 |
| SECTION 11 | | |
| 0.494 | −0.169 | 5.960 |
| 0.491 | −0.171 | 5.960 |
| 0.488 | −0.172 | 5.960 |
| 0.485 | −0.174 | 5.960 |
| 0.483 | −0.176 | 5.960 |
| 0.480 | −0.177 | 5.960 |
| 0.477 | −0.179 | 5.960 |
| 0.474 | −0.181 | 5.960 |
| 0.471 | −0.182 | 5.960 |
| 0.468 | −0.184 | 5.960 |
| 0.465 | −0.185 | 5.960 |
| 0.450 | −0.192 | 5.960 |
| 0.435 | −0.199 | 5.960 |
| 0.420 | −0.205 | 5.960 |
| 0.404 | −0.210 | 5.960 |
| 0.388 | −0.215 | 5.960 |
| 0.372 | −0.219 | 5.960 |
| 0.356 | −0.222 | 5.960 |
| 0.340 | −0.225 | 5.960 |
| 0.323 | −0.227 | 5.960 |
| 0.307 | −0.229 | 5.960 |
| 0.290 | −0.230 | 5.960 |
| 0.274 | −0.230 | 5.960 |
| 0.257 | −0.230 | 5.960 |
| 0.241 | −0.229 | 5.960 |
| 0.224 | −0.228 | 5.960 |
| 0.208 | −0.226 | 5.960 |
| 0.192 | −0.224 | 5.960 |
| 0.175 | −0.221 | 5.960 |
| 0.159 | −0.218 | 5.960 |
| 0.143 | −0.214 | 5.960 |
| 0.127 | −0.209 | 5.960 |
| 0.112 | −0.204 | 5.960 |
| 0.096 | −0.199 | 5.960 |
| 0.081 | −0.193 | 5.960 |
| 0.065 | −0.187 | 5.960 |

TABLE 2-continued

| X | Y | Z |
|---|---|---|
| 0.050 | −0.180 | 5.960 |
| 0.035 | −0.173 | 5.960 |
| 0.021 | −0.165 | 5.960 |
| 0.006 | −0.157 | 5.960 |
| −0.008 | −0.149 | 5.960 |
| −0.022 | −0.140 | 5.960 |
| −0.036 | −0.131 | 5.960 |
| −0.049 | −0.122 | 5.960 |
| −0.063 | −0.112 | 5.960 |
| −0.076 | −0.102 | 5.960 |
| −0.089 | −0.092 | 5.960 |
| −0.102 | −0.082 | 5.960 |
| −0.114 | −0.071 | 5.960 |
| −0.127 | −0.060 | 5.960 |
| −0.139 | −0.049 | 5.960 |
| −0.151 | −0.037 | 5.960 |
| −0.162 | −0.026 | 5.960 |
| −0.174 | −0.014 | 5.960 |
| −0.185 | −0.002 | 5.960 |
| −0.196 | 0.010 | 5.960 |
| −0.207 | 0.022 | 5.960 |
| −0.218 | 0.035 | 5.960 |
| −0.229 | 0.047 | 5.960 |
| −0.239 | 0.060 | 5.960 |
| −0.250 | 0.073 | 5.960 |
| −0.260 | 0.086 | 5.960 |
| −0.270 | 0.099 | 5.960 |
| −0.279 | 0.113 | 5.960 |
| −0.289 | 0.126 | 5.960 |
| −0.298 | 0.140 | 5.960 |
| −0.307 | 0.153 | 5.960 |
| −0.317 | 0.167 | 5.960 |
| −0.325 | 0.181 | 5.960 |
| −0.334 | 0.195 | 5.960 |
| −0.343 | 0.209 | 5.960 |
| −0.351 | 0.223 | 5.960 |
| −0.360 | 0.238 | 5.960 |
| −0.368 | 0.252 | 5.960 |
| −0.376 | 0.266 | 5.960 |
| −0.384 | 0.281 | 5.960 |
| −0.392 | 0.295 | 5.960 |
| −0.400 | 0.310 | 5.960 |
| −0.407 | 0.324 | 5.960 |
| −0.415 | 0.339 | 5.960 |
| −0.422 | 0.354 | 5.960 |
| −0.430 | 0.369 | 5.960 |
| −0.437 | 0.383 | 5.960 |
| −0.444 | 0.398 | 5.960 |
| −0.452 | 0.413 | 5.960 |
| −0.459 | 0.428 | 5.960 |
| −0.466 | 0.443 | 5.960 |
| −0.473 | 0.457 | 5.960 |
| −0.480 | 0.472 | 5.960 |
| −0.488 | 0.487 | 5.960 |
| −0.489 | 0.490 | 5.960 |
| −0.490 | 0.493 | 5.960 |
| −0.492 | 0.496 | 5.960 |
| −0.493 | 0.499 | 5.960 |
| −0.495 | 0.502 | 5.960 |
| −0.496 | 0.505 | 5.960 |
| −0.498 | 0.508 | 5.960 |
| −0.499 | 0.511 | 5.960 |
| −0.500 | 0.514 | 5.960 |
| −0.502 | 0.517 | 5.960 |
| −0.503 | 0.519 | 5.960 |
| −0.503 | 0.521 | 5.960 |
| −0.503 | 0.523 | 5.960 |
| −0.503 | 0.525 | 5.960 |
| −0.502 | 0.527 | 5.960 |
| −0.501 | 0.528 | 5.960 |
| −0.500 | 0.530 | 5.960 |
| −0.499 | 0.532 | 5.960 |
| −0.498 | 0.533 | 5.960 |
| −0.496 | 0.534 | 5.960 |
| −0.494 | 0.534 | 5.960 |
| −0.492 | 0.535 | 5.960 |
| −0.490 | 0.535 | 5.960 |
| −0.488 | 0.534 | 5.960 |

TABLE 2-continued

| X | Y | Z |
|---|---|---|
| −0.486 | 0.534 | 5.960 |
| −0.484 | 0.533 | 5.960 |
| −0.483 | 0.532 | 5.960 |
| −0.481 | 0.531 | 5.960 |
| −0.480 | 0.529 | 5.960 |
| −0.478 | 0.526 | 5.960 |
| −0.477 | 0.524 | 5.960 |
| −0.475 | 0.521 | 5.960 |
| −0.474 | 0.519 | 5.960 |
| −0.472 | 0.516 | 5.960 |
| −0.471 | 0.514 | 5.960 |
| −0.469 | 0.511 | 5.960 |
| −0.467 | 0.509 | 5.960 |
| −0.466 | 0.506 | 5.960 |
| −0.464 | 0.504 | 5.960 |
| −0.456 | 0.491 | 5.960 |
| −0.448 | 0.479 | 5.960 |
| −0.440 | 0.466 | 5.960 |
| −0.432 | 0.454 | 5.960 |
| −0.424 | 0.442 | 5.960 |
| −0.416 | 0.429 | 5.960 |
| −0.407 | 0.417 | 5.960 |
| −0.399 | 0.405 | 5.960 |
| −0.391 | 0.393 | 5.960 |
| −0.382 | 0.380 | 5.960 |
| −0.374 | 0.368 | 5.960 |
| −0.365 | 0.356 | 5.960 |
| −0.356 | 0.345 | 5.960 |
| −0.347 | 0.333 | 5.960 |
| −0.338 | 0.321 | 5.960 |
| −0.329 | 0.309 | 5.960 |
| −0.320 | 0.298 | 5.960 |
| −0.311 | 0.286 | 5.960 |
| −0.301 | 0.275 | 5.960 |
| −0.292 | 0.263 | 5.960 |
| −0.282 | 0.252 | 5.960 |
| −0.272 | 0.241 | 5.960 |
| −0.263 | 0.230 | 5.960 |
| −0.253 | 0.219 | 5.960 |
| −0.243 | 0.208 | 5.960 |
| −0.232 | 0.197 | 5.960 |
| −0.222 | 0.186 | 5.960 |
| −0.212 | 0.176 | 5.960 |
| −0.201 | 0.165 | 5.960 |
| −0.191 | 0.155 | 5.960 |
| −0.180 | 0.145 | 5.960 |
| −0.169 | 0.134 | 5.960 |
| −0.158 | 0.124 | 5.960 |
| −0.147 | 0.115 | 5.960 |
| −0.136 | 0.105 | 5.960 |
| −0.125 | 0.095 | 5.960 |
| −0.113 | 0.086 | 5.960 |
| −0.102 | 0.076 | 5.960 |
| −0.090 | 0.067 | 5.960 |
| −0.079 | 0.058 | 5.960 |
| −0.067 | 0.049 | 5.960 |
| −0.055 | 0.040 | 5.960 |
| −0.043 | 0.032 | 5.960 |
| −0.030 | 0.023 | 5.960 |
| −0.018 | 0.015 | 5.960 |
| −0.006 | 0.007 | 5.960 |
| 0.007 | −0.001 | 5.960 |
| 0.019 | −0.009 | 5.960 |
| 0.032 | −0.016 | 5.960 |
| 0.045 | −0.024 | 5.960 |
| 0.058 | −0.031 | 5.960 |
| 0.071 | −0.038 | 5.960 |
| 0.084 | −0.045 | 5.960 |
| 0.097 | −0.051 | 5.960 |
| 0.111 | −0.057 | 5.960 |
| 0.124 | −0.064 | 5.960 |
| 0.138 | −0.070 | 5.960 |
| 0.152 | −0.075 | 5.960 |
| 0.165 | −0.081 | 5.960 |
| 0.179 | −0.086 | 5.960 |
| 0.193 | −0.091 | 5.960 |
| 0.207 | −0.095 | 5.960 |
| 0.221 | −0.100 | 5.960 |

TABLE 2-continued

| X | Y | Z |
|---|---|---|
| 0.236 | −0.104 | 5.960 |
| 0.250 | −0.108 | 5.960 |
| 0.264 | −0.111 | 5.960 |
| 0.279 | −0.115 | 5.960 |
| 0.293 | −0.117 | 5.960 |
| 0.308 | −0.120 | 5.960 |
| 0.323 | −0.122 | 5.960 |
| 0.337 | −0.125 | 5.960 |
| 0.352 | −0.126 | 5.960 |
| 0.367 | −0.128 | 5.960 |
| 0.381 | −0.129 | 5.960 |
| 0.396 | −0.130 | 5.960 |
| 0.411 | −0.130 | 5.960 |
| 0.426 | −0.130 | 5.960 |
| 0.441 | −0.130 | 5.960 |
| 0.456 | −0.129 | 5.960 |
| 0.458 | −0.129 | 5.960 |
| 0.461 | −0.129 | 5.960 |
| 0.464 | −0.129 | 5.960 |
| 0.467 | −0.129 | 5.960 |
| 0.470 | −0.128 | 5.960 |
| 0.473 | −0.128 | 5.960 |
| 0.476 | −0.128 | 5.960 |
| 0.479 | −0.128 | 5.960 |
| 0.482 | −0.127 | 5.960 |
| 0.485 | −0.127 | 5.960 |
| 0.489 | −0.127 | 5.960 |
| 0.492 | −0.127 | 5.960 |
| 0.496 | −0.128 | 5.960 |
| 0.499 | −0.129 | 5.960 |
| 0.502 | −0.131 | 5.960 |
| 0.505 | −0.133 | 5.960 |
| 0.508 | −0.135 | 5.960 |
| 0.510 | −0.138 | 5.960 |
| 0.511 | −0.141 | 5.960 |
| 0.512 | −0.145 | 5.960 |
| 0.511 | −0.148 | 5.960 |
| 0.510 | −0.151 | 5.960 |
| 0.509 | −0.155 | 5.960 |
| 0.507 | −0.158 | 5.960 |
| 0.505 | −0.160 | 5.960 |
| 0.502 | −0.163 | 5.960 |
| 0.500 | −0.165 | 5.960 |
| 0.497 | −0.167 | 5.960 |

It should be understood that the finished second stage power turbine vane 40*b* does not necessarily include all the sections defined in Table 2. The portion of the airfoil 54 proximal to the platforms 60 and 62 may not be defined by a profile section 66. It should be considered that the vane 40*b* airfoil profile proximal to the platforms 60, 62 may vary due to several imposed constraints. However, the vane 40*b* has an intermediate airfoil portion 64 defined between platforms 60, 62 thereof and which has a profile defined on the basis of at least the intermediate sections of the various vane profile sections 66 defined in Table 2.

It should be appreciated that the intermediate airfoil portion 64 of the vane 40*b* is defined between the inner and outer gaspath walls 28 and 30 and that the platforms 60, 62 forms part of the gaspath walls 28, 30. The airfoil profile physically appearing on vane 40*b* and fully contained in the gaspath includes Sections 2 to 10 of Table 2. The remaining sections are at least partly located outside of the gaspath 27, but are provided, in part, to fully define the airfoil surface and/or, in part, to improve curve-fitting of the airfoil at its radially distal portions. The skilled reader will appreciate that a suitable fillet radius is to be applied between the platforms 60, 62 and the airfoil portion of the vane. The vane inner diameter and outer diameter endwall fillet is in the range of about 0.080" to about 0.160". The local ID/OD endwall profile tolerance is +/−0.075".

Figure 4:
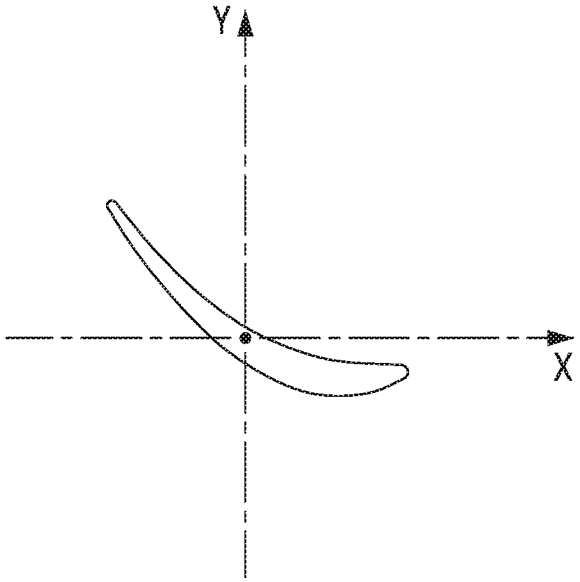
FIG. 4 is a schematic simplified power turbine vane airfoil cross-section illustrating the angular twist tolerances.

FIG. 4 illustrates the tolerances on twist angles. The twist "N" is an angular variation at each vane section, whereas restagger is the angular reposition of the entire airfoil. Both the twist and the restagger angles are about the stacking line 48. The section twist "N" (section restagger) tolerance with respect to the stacking line is +/−0.75 degrees (casting tolerance). The global restagger capability for the airfoil with respect to the stacking line is full stager capabililty (airfoil can be fully closed or open).

The above description is meant to be exemplary only, and one skilled in the art will recognize that changes may be made to the embodiments described without department from the scope of the invention disclosed. All modifications which fall within the scope of the present invention will be apparent to those skilled in the art, in light of a review of this disclosure, and such modifications are intended to fall within the appended claims.

The invention claimed is:

1. A turbine vane of a gas turbine engine having a gaspath, the turbine vane comprising an airfoil having an intermediate portion contained within the gaspath and defined by a nominal un-coated profile in accordance with Cartesian coordinate values of orthogonally related axes X, Y, and Z of Sections 2 to 10 set forth in Table 2 and incorporated by reference herein, wherein a point of origin of the orthogonally related axes X, Y and Z is located at an intersection of a centerline of the gas turbine engine and a stacking line of the turbine vane, the Z values are radial distances measured along the stacking line, the X and Y values are coordinate values defining the profile at each distance Z, wherein X and Y values define a set of points for each Z value which when connected by smooth continuing arcs define an airfoil profile section, the profile sections at the Z distances being joined smoothly with one another to form an airfoil shape of the intermediate portion.

2. The turbine vane as defined in claim 1, wherein the turbine vane is a power turbine vane of the gas turbine engine.

3. The turbine vane as defined in claim 2, wherein the power turbine vane is a second stage power turbine vane of a multi-stage power turbine.

4. The turbine vane as defined in claim 1, wherein the turbine vane has a manufacturing tolerance of ±0.018 inches in a direction perpendicular to the airfoil.

5. A turbine vane for a gas turbine engine having a gaspath, the turbine vane having an intermediate airfoil portion contained within the gaspath and defined by a cold un-coated nominal profile in accordance with Cartesian coordinate values of orthogonally related axes X, Y, and Z of Sections 2 to 10 set forth in Table 2 and incorporated by reference herein, wherein a point of origin of the orthogonally related axes X, Y and Z is located at an intersection of a centerline of the gas turbine engine and a stacking line of the turbine vane, the Z values are radial distances measured along the stacking line, the X and Y values are coordinate values defining the profile at each distance Z.

6. The turbine vane as defined in claim 5, wherein the turbine vane is a power turbine vane of the gas turbine engine.

7. The turbine vane as defined in claim 6, wherein the power turbine vane is a second stage power turbine vane of a multi-stage power turbine.

8. The turbine vane as defined in claim 6, wherein the power turbine vane has a manufacturing tolerance of ±0.018 inches.

9. A turbine stator assembly for a gas turbine engine having a gaspath, the turbine stator assembly comprising a plurality of vanes, each vane including an airfoil having an intermediate portion contained within the gaspath and defined by a cold un-coated nominal profile in accordance with Cartesian coordinate values of orthogonally related axes X, Y, and Z of Sections 2 to 9 set forth in Table 2 and incorporated by reference herein, wherein a point of origin of the orthogonally related axes X, Y and Z is located at an intersection of a centerline of the gas turbine engine and a stacking line of the turbine vane, the Z values are radial distances measured along the stacking line, the X and Y values are coordinate values defining the profile at each distance Z.

10. A second stage power turbine vane comprising: at least one airfoil having a surface lying on points of Table 2 and incorporated by reference herein, the airfoil extending between platforms defined by coordinate values given in Table 1 and incorporated by reference herein, wherein a fillet radius is applied around the airfoil between the airfoil and platforms.

* * * * *